US010040294B2

(12) United States Patent
Kimura et al.

(10) Patent No.: US 10,040,294 B2
(45) Date of Patent: Aug. 7, 2018

(54) LIQUID CONSUMING APPARATUS AND ASSEMBLY METHOD FOR THE SAME

(71) Applicant: SEIKO EPSON CORPORATION, Tokyo (JP)

(72) Inventors: Naomi Kimura, Nagano (JP); Taisuke Hashimoto, Osaka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/370,346

(22) Filed: Dec. 6, 2016

(65) Prior Publication Data

US 2017/0197429 A1 Jul. 13, 2017

(30) Foreign Application Priority Data

Jan. 8, 2016 (JP) ..... 2016-002499

(51) Int. Cl.
*B41J 2/175* (2006.01)

(52) U.S. Cl.
CPC ..... *B41J 2/17566* (2013.01)

(58) Field of Classification Search
CPC .... B41J 2/1753; B41J 2/17553; B41J 2/1752; B41J 2/17546; B41J 2/17523; B41J 2/17526; B41J 2/17503; B41J 2/17559; B41J 2/17566; B41J 2002/14491; B41J 29/02; B41J 2/17509; B41J 29/38
USPC ..... 347/6, 7, 19, 49, 50, 85, 86
See application file for complete search history.

(56) References Cited

U.S. PATENT DOCUMENTS

| | | | | |
|---|---|---|---|---|
| 5,250,957 | A | 10/1993 | Onozato | |
| 2013/0258009 | A1* | 10/2013 | Asauchi | B41J 2/17566 347/86 |
| 2015/0251426 | A1* | 9/2015 | Yokoyama | B41J 2/1629 347/50 |
| 2015/0343779 | A1* | 12/2015 | Takagi | B41J 2/1433 347/50 |

FOREIGN PATENT DOCUMENTS

JP 05-031915 A 2/1993

* cited by examiner

*Primary Examiner* — Jannelle M Lebron

(57) ABSTRACT

A technique that enables electrical connectivity of a liquid container to a conductive member to be enhanced is provided. A liquid consuming apparatus includes a liquid container in which liquid is contained, a conductive member, at least a part of which is arranged within the liquid container, a circuit board that applies a voltage to the conductive member, a wire that electrically connects the conductive member and the circuit board to each other, and a board holding member that holds the circuit board. The board holding member is provided with a through hole through which the wire is passed, and the wire extends from the through hole and is connected to the circuit board.

9 Claims, 30 Drawing Sheets

PWM OUTPUT
VDD
VSS
t1
A
t2
t3
t4

PWM OUTPUT
VDD
VSS
t1
T1
T2

DETECTION VOLTAGE V1
VDD
VSS

POTENTIAL V2
VDD
THRESHOLD
VSS

DETECTION VOLTAGE V1
VDD
VSS

OUTPUT V3
VDD
VSS

DETERMINATION VOLTAGE VJ
VDD
VSS

LIQUID CONSUMING APPARATUS AND ASSEMBLY METHOD FOR THE SAME

BACKGROUND

1. Technical Field

The present invention relates to liquid consuming apparatuses and assembly methods for the liquid consuming apparatuses.

2. Related Art

Inkjet printers (hereinafter referred to simply as "printers") that discharge ink to form images are known as a form of liquid consuming apparatus in which liquid is consumed while the apparatus is driven. In some kinds of printers, the amount of remaining ink contained in an ink tank is electrically detected (e.g. later-mentioned JP-A-5-31915). In general, in such a printer, a conductive member that constitutes a terminal such as an electrode pin is attached to an ink tank, and a voltage is applied to the ink in the ink tank via this conductive member.

In the printer in which a voltage is applied to the ink in the ink tank via the conductive member and information regarding the ink, such as the amount of remaining ink, is detected, it is desirable that the state of electrical connection regarding this conductive member is favorably ensured, in order to increase the detection accuracy. In particular, there are cases where, in printers, vibration occurs due to print processing. Therefore, it is desirable that the electrical connection regarding the conductive member is ensured, without interruption, against an impact such as vibration. Moreover, in order to reduce the cost of manufacturing a printer, it is desirable that the printer is configured such that the electrical connection regarding the conductive member can be ensured with a simpler configuration or a simple connection method. Thus, in printers, it is desirable that the electrical connectivity to the conductive member attached to the ink tank can be enhanced. This problem is not limited to printers, and is common to liquid consuming apparatuses in which information regarding liquid, which is a consumable item, is electrically detected.

SUMMARY

The invention has been made to solve at least a part of the foregoing problem, and can be achieved in the following modes.

[1] In a first mode of the invention, a liquid consuming apparatus is provided. This liquid consuming apparatus may include a liquid container, a conductive member, a circuit board, a wire, and a board holding member. Liquid may be contained in the liquid container. At least a part of the conductive member may be arranged within the liquid container. The circuit board may be arranged outside the liquid container and apply a voltage to the conductive member. The wire may electrically connect the conductive member and the circuit board to each other. The board holding member may be arranged between the liquid container and the circuit board, and hold the circuit board. The board holding member may be provided with a through hole through which the wire is passed. The wire may be connected to the circuit board through the through hole. With the liquid consuming apparatus in this mode, the wire is led while being guided by the board holding member. Therefore, the stability of the state of the connection of the wire to the conductive member is enhanced, and the electrical connectivity to the conductive member is enhanced. In addition, the manageability of the wire when being connected to the circuit board is enhanced.

[2] In the liquid consuming apparatus in the above mode, the through hole may have an opening region that does not overlap the circuit board, when viewed in an opening direction of the through hole, and the wire may extend out toward the circuit board via the opening region. With the liquid consuming apparatus in this mode, the wire can be readily led to the circuit board.

[3] In the liquid consuming apparatus in the above mode, the conductive member and the wire may be connected to each other via a connecting member, and the connecting member may have a welding part to which the conductive member is welded, and a soldering part to which the wire is soldered. With the liquid consuming apparatus in this mode, the electrical connectivity between the wire and the conductive member is enhanced by the connecting member, and the wire and the conductive member can be coupled more firmly.

[4] In the liquid consuming apparatus in the above mode, the conductive member may include a first conductive member and a second conductive member that are attached to the liquid container, the wire may include a first wire connected to the first conductive member, and a second wire connected to the second conductive member, and the first wire and the second wire may be connected to the circuit board via the through hole. With the liquid consuming apparatus in this mode, the electrical connectivity of the first wire and the second wire to the respective conductive members can be increased. In addition, favorable manageability of the first wire and the second wire can be achieved.

[5] The liquid consuming apparatus in the above mode may include a wiring member including the first wire, the second wire, and a connector that is interposed for connection of the first wire and the second wire to the circuit board. The circuit board may include a connecting portion to which the connector is connected. With the liquid consuming apparatus in this mode, the wiring member facilitates connection of the conductive members to the circuit board.

[6] The liquid consuming apparatus in the above mode may include a plurality of the liquid containers. The liquid containers may each include a pair of the first conductive member and the second conductive member that are connected to the circuit board via the wiring member, the board holding member may be installed spanning the liquid containers so as to face the liquid containers, and the board holding member may be provided with a plurality of the through holes at positions corresponding to the plurality of liquid containers. With this liquid consuming apparatus, the connectivity of the wires to the pair of conductive members attached to each of the plurality of liquid containers is enhanced.

[7] In the liquid consuming apparatus in the above mode, the first conductive member and the second conductive member each may be a columnar member, the first conductive member and the second conductive member may be inserted in parallel into the liquid container such that leading ends of the first conductive member and the second conductive member are arranged within the liquid container, the first wire may be connected to a trailing end of the first conductive member projecting from the liquid container, the second wire may be connected to a trailing end of the second conductive member projecting from the liquid container, and the through hole may be located on extensions of center axes of the first conductive member and the second conductive member. With the liquid consuming apparatus in this mode, the first wire and the second wire can be readily led, and the connectivity between the circuit board and the conductive members is further enhanced.

[8] In the liquid consuming apparatus in the above mode, the connecting portion may be located at a position shifted from extensions of center axes of the first conductive member and the second conductive member. With the liquid consuming apparatus in this mode, the wiring member can be readily led to the connecting portion.

[9] The liquid consuming apparatus in the above mode may further include a control unit that is connected to the circuit board via a wiring cable, and detects information regarding the liquid by using the voltage applied to the conductive member by the circuit board. With the liquid consuming apparatus in this mode, the accuracy of detection of the information regarding liquid is increased.

[10] In the liquid consuming apparatus in the above mode, the control unit may detect, as the information regarding the liquid, information regarding an amount of the liquid contained in the liquid container. With the liquid consuming apparatus in this mode, the accuracy of detection of the amount of liquid contained in the liquid container is increased.

[11] In a second mode of the invention, a liquid consuming apparatus assembly method is provided. This assembly method may include a wire connecting step, a conductive member attaching step, a board arranging step, and a wiring step. The wire connecting step may be a step of attaching a wire to a conductive member. The conductive member attaching step may be a step of arranging at least a part of the conductive member within a region where liquid is contained in a liquid container, in which the liquid is to be contained. The board arranging step may be a step of causing a board holding member to hold a circuit board that applies a voltage to the conductive member, and arranging the board holding member such that the board holding member is located between the circuit board and the liquid container. The wiring step may be a step of electrically connecting the circuit board and the conductive member to each other by passing the wire through a through hole provided in the board holding member, leading the wire from the liquid container to the circuit board, and connecting the wire to the circuit board. With the assembly method in this mode, the connection between the circuit board and the conductive member is facilitated, and the electrical connectivity to the conductive member is enhanced.

[12] In the assembly method in the above mode, the conductive member may include a first conductive member and a second conductive member, the wire may include a first wire and a second wire, the wire connecting step may be a step of connecting the first wire to the first conductive member, and connecting the second wire to the second conductive member, and the wiring step may be a step of connecting the first wire and the second wire to the circuit board via the through hole. With the assembly method in this mode, the connectivity between the circuit board and the pair of conductive members, namely the first conductive member and the second conductive member via the first wire and the second wire can be enhanced.

[13] In the assembly method in the above mode, the wire connecting step may be a step of connecting the conductive member and the wire to each other via a connecting member, and include a step of welding the conductive member to the connecting member and a step of soldering the wire to the connecting member. With the assembly method in this mode, the connectivity between the conductive member and the wire is further enhanced.

[14] The assembly method in the above mode may further include a cable wiring step of electrically connecting the circuit board and a control unit that detects information regarding the liquid using the voltage applied to the liquid by the circuit board, to each other via a wiring cable. With the assembly method in this mode, the electrical connection between the circuit board and the control unit is facilitated.

Not all of the plurality of constituent elements provided in the above modes of the invention are essential, and some of the plurality of constituent elements may be modified, removed, or replaced with other new constituent elements, or the limitations may be partially deleted as appropriate, in order to solve a part of or the entire problem described above, or in order to achieve some or all of the effects described in this specification. To solve a part of or the entire foregoing problem, or to achieve some or all of the effects described in this specification, some or all of the technical features included in one of the above modes of the invention may be combined with some or all of the technical features included in another one of the above modes of the invention to make an independent mode of the invention.

The invention can also be achieved in various modes other than the liquid consuming apparatus and the liquid consuming apparatus assembly method. For example, the invention can be achieved in modes such as a detection device that electrically detects information regarding liquid, an assembly method for this detection device, a liquid containing unit that includes a plurality of liquid containers, an assembly method for a liquid containing unit, a connecting member to be electrically connected to a liquid container, a manufacturing method or attaching method for this connecting member, a liquid consuming apparatus manufacturing method, and a wiring method for a liquid consuming apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment:

A first embodiment of the invention will be described in the following order.

A1. Schematic configuration of printer:

A2. Schematic configuration of tank unit:

A3. Configuration of ink tank:

A4. Schematic configuration of circuit board:

A5. Schematic configuration of board holding member:

A6. Assembly of tank unit and connection to printing unit:

A7. Connecting member manufacturing method:

A8. Circuitry for ink detection and ink detection method:

A9. Summary of first embodiment:

A1. Schematic Configuration of Printer

Figure 1:
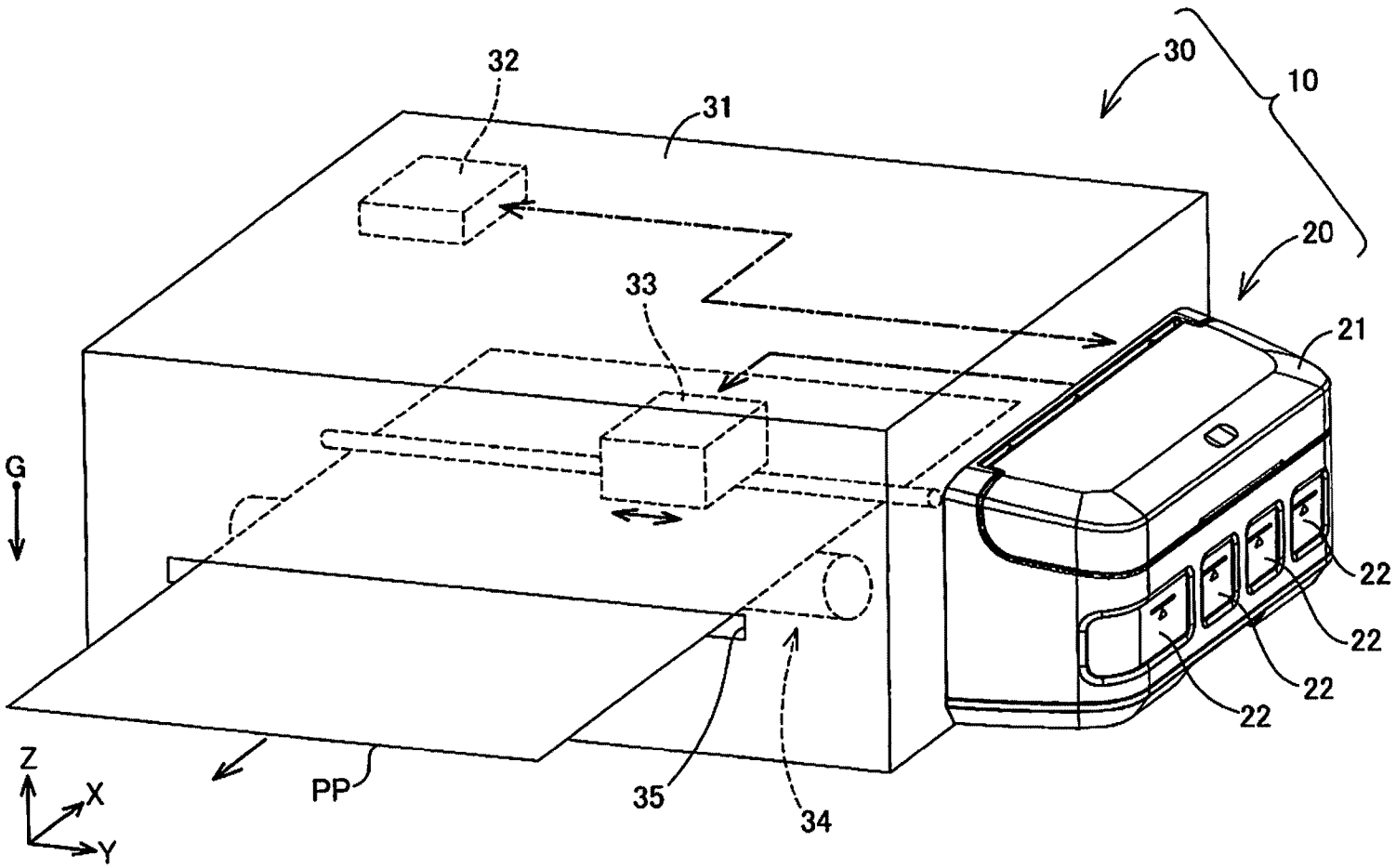
FIG. 1 is a schematic perspective view showing a configuration of a printer according to a first embodiment.

FIG. 1 is a schematic perspective view showing a configuration of a printer 10 according to the first embodiment of the invention. FIG. 1 shows an arrow G that indicates a gravity direction when the printer 10 is in a normal use state. In this specification, "upper/above" and "lower/below" mean the up-down direction based on the gravity direction, unless otherwise stated. FIG. 1 also shows arrows X, Y, and Z that indicate three orthogonal directions. The arrow X indicates a horizontal direction from the front face side of the printer 10 on which an operation unit (not shown) for a user is provided and print paper PP is discharged, toward the back face side, which is opposite to the front face side. A direction parallel to the arrow X is the front-rear direction of the printer 10. The arrow Y indicates a horizontal direction from left to right when the user directly faces the front face of the printer 10. A direction parallel to the arrow Y is a lateral direction (width direction) of the printer 10. The arrow Z indicates a direction opposite to the gravity direction, and indicates the height direction of the printer 10. In this specification, the directions (positive directions) of the arrows X, Y, and Z mean the directions pointed by respective leading ends of the arrows X, Y, and Z, and the directions opposite to the arrows X, Y, and Z mean the directions that are respectively opposite thereto. The four arrows G, X, Y, and Z are also shown as appropriate in diagrams referenced in this specification, based on an installation orientation of the printer 10 that is in a normal use state.

The printer 10, which is an inkjet printer, discharges ink droplets onto the print paper PP, which is a print medium, and forms an image on a print face of the print paper PP. The printer 10 is a form of liquid consuming apparatus that consumes ink, which is liquid. The printer 10 includes a tank unit 20 and a printing unit 30. The tank unit 20 is detachably attached to a right side face of the printing unit 30 by means of screwing or the like. The tank unit 20 houses a plurality of ink tanks 22 within a casing 21 of the tank unit 20, and supplies ink to be used in print processing from the ink tanks 22 to the printing unit 30. In this embodiment, the tank unit 20 has four ink tanks 22, and color inks of cyan (C), magenta (M), yellow (Y), and black (K) are respectively contained therein. The ink tanks 22 each correspond to a specific concept of a liquid container according to the invention. A configuration of the tank unit 20 will be described later.

The printing unit 30 has, within a casing 31 that is a resin hollow box, a control unit 32, a print head 33, and a conveyance mechanism 34. The control unit 32 is constituted by a microcomputer that includes at least a central processing unit and a main storage device. The control unit 32 performs various functions as a result of the central processing unit loading various programs to the main storage device and executing these programs. In this embodiment, the control unit 32 functions as a print processing unit that controls each constituent part of the printing unit 30 and executes print processing based on printing data that is input from the outside of the control unit 32. The control unit 32 also has a function of exchanging an electrical signal with a circuit portion (not shown) in the tank unit 20 and detecting information regarding ink contained in the ink tanks 22 (details will be described later).

The print head 33 includes an ink chamber that contains ink, and a nozzle is that in communication with the ink chamber and is open downward (not shown). The print head 33 discharges the ink in the ink chamber from the nozzle by a known method such as applying pressure to the ink using a piezoelectric element, for example, under the control of the control unit 32. The print head 33 linearly moves back and forth in the positive direction of the arrow Y and the opposite direction under the control of the control unit 32. In this embodiment, a direction parallel to the arrow Y is the main scanning direction in the printer 10. The printing unit 30 includes, as a driving mechanism for moving the print head 33, a rail for the print head 33 to move on, a motor that generates a driving force, and a pulley that transmits this driving force (not shown or described in detail). The print head 33 is supplied with the ink from the ink tanks 22 in the tank unit 20 via a plurality of flexible resin tubes (not shown).

The conveyance mechanism 34 includes a conveyance roller that conveys the print paper PP and a drive motor that drives the conveyance roller, and conveys the print paper PP at a given conveyance speed under the control of the control unit 32. When the printer 10 executes print processing, the print paper PP is conveyed in the direction opposite to the arrow X, from a region below the print head 33 toward an opening 35, which is provided in the front face of the casing 31. In this embodiment, the direction parallel to the arrow Y is the sub-scanning direction in the printer 10. When print processing is executed, the control unit 32 moves the print head 33 back and forth in the main scanning direction while conveying the print paper PP in the sub-scanning direction, and causes the print head 33 to discharge ink droplets onto a print face of the print paper PP at a timing that is determined based on printing data.

A2. Schematic Configuration of Tank Unit

Figure 2:
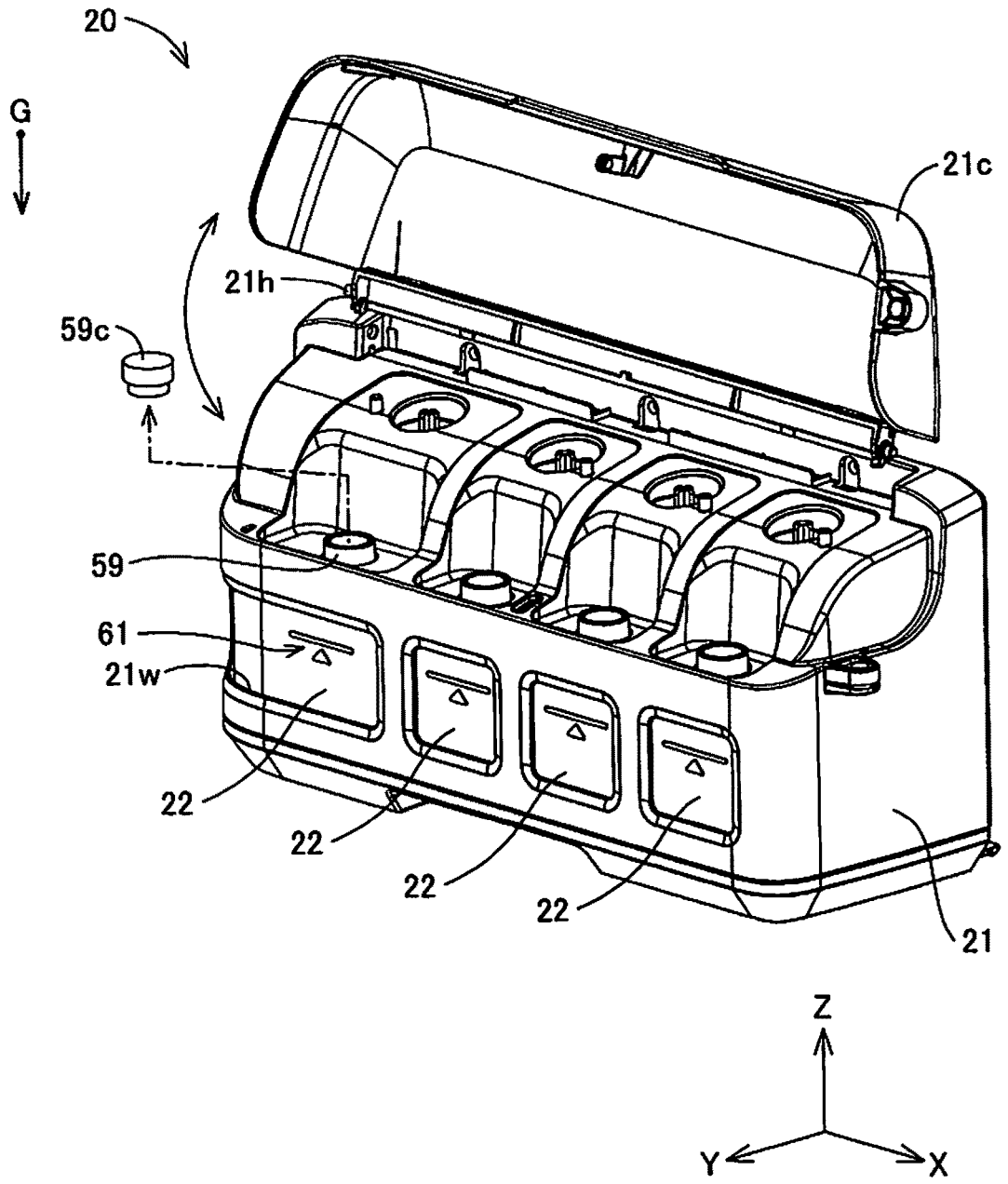
FIG. 2 is a schematic perspective view of a tank unit as viewed from the front face side.
Figure 3:
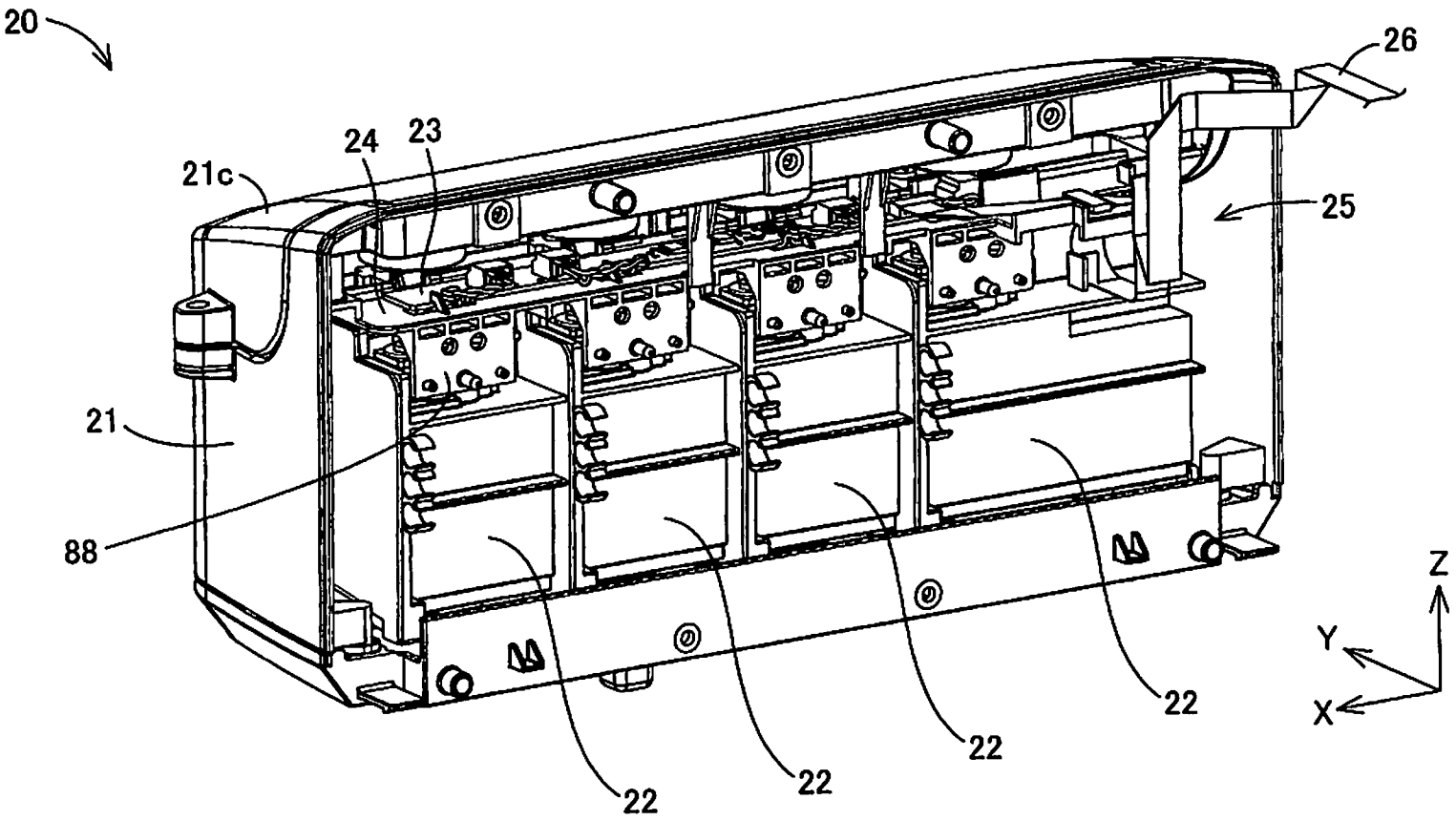
FIG. 3 is a schematic perspective view of the tank unit as viewed from the back face side.
Figure 4:
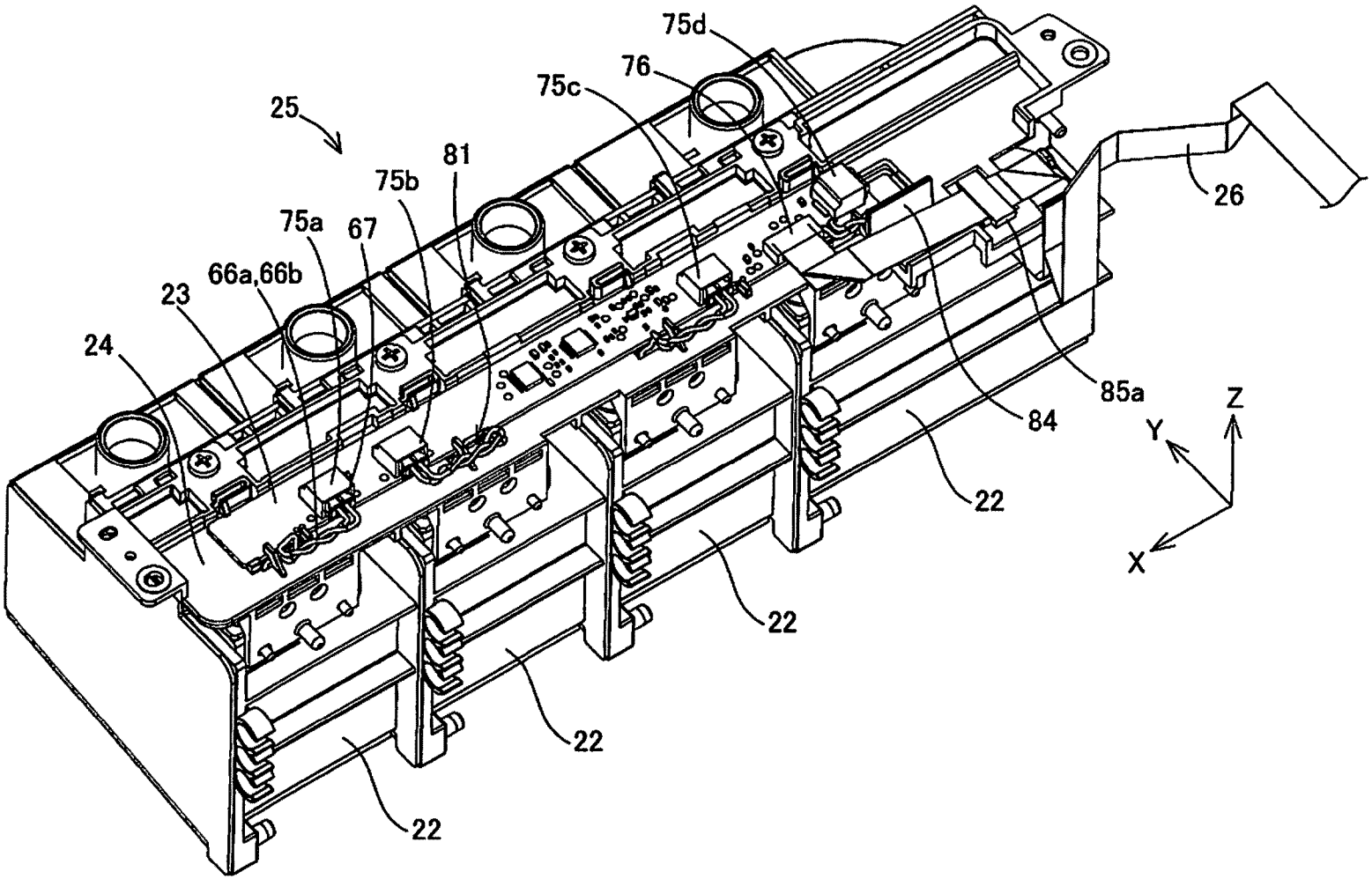
FIG. 4 is a schematic perspective view of an internal unit of the tank unit as viewed from the back face side.
Figure 5:
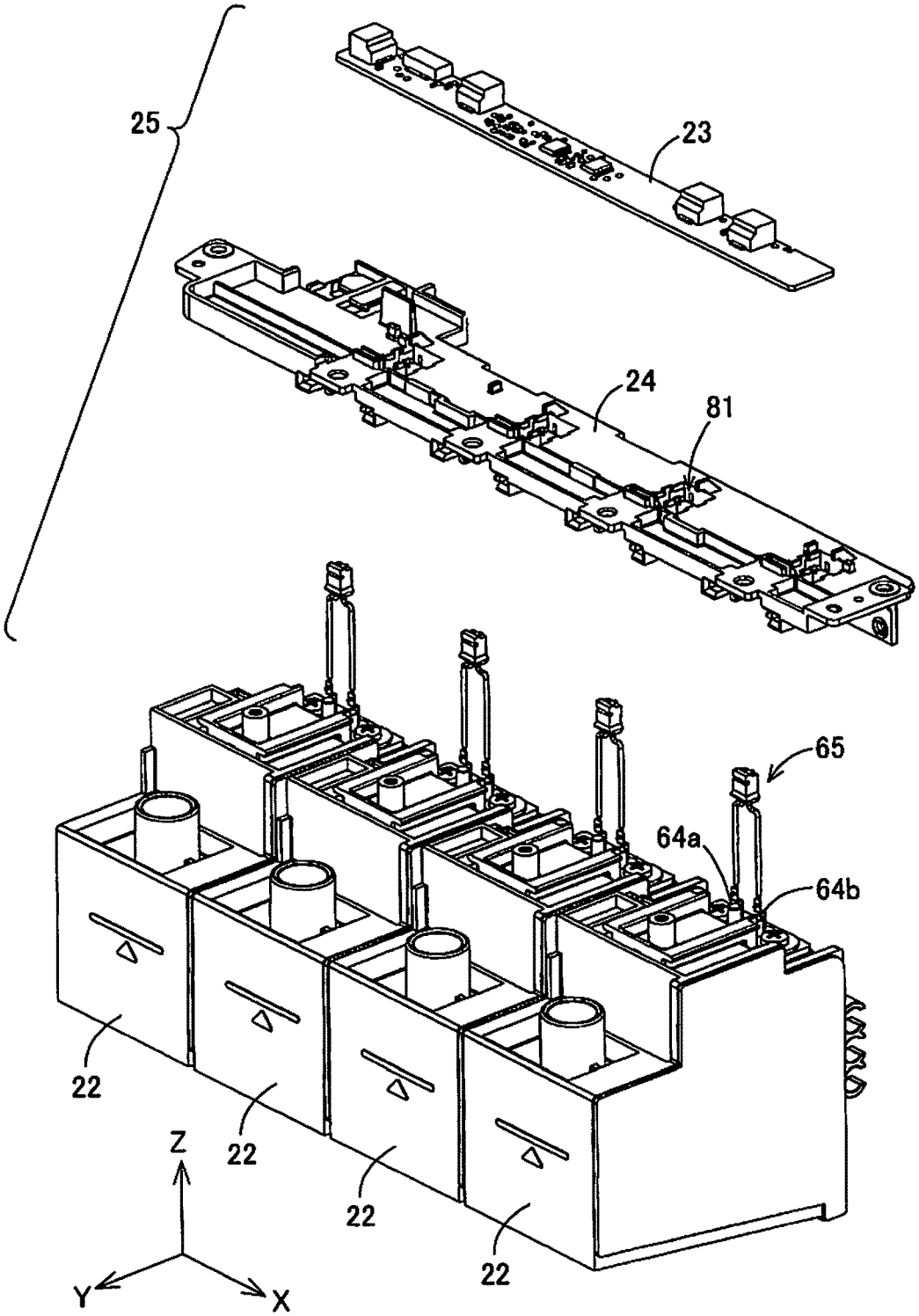
FIG. 5 is a schematic exploded perspective view of the internal unit.

FIG. 2 is a schematic perspective view of the tank unit 20 as viewed from the front face side. FIG. 2 shows a state where a lid 21*c* of the casing 21 is open, and cap members 59*c* of the ink tanks 22 have been removed. FIG. 3 is a schematic perspective view of the tank unit 20 with the lid 21*c* closed, as viewed from the back face side. FIG. 4 is a schematic perspective view of an internal unit 25 of the tank unit 20 as viewed from the back face side. FIG. 5 is a schematic exploded perspective view of the internal unit 25. Here, the front face of the tank unit 20 is a face on the side in the opposite to arrow Y direction, and is a face that constitutes a right side face of the printer 10. The back face of the tank unit 20 is a face on the side in a direction to the arrow Y, and is a face that is oriented toward the printing unit 30 when the tank unit 20 is attached to the printer 10. In the tank unit 20, a direction parallel to the arrow Y is the front-rear direction thereof, and a direction parallel to the arrow X is the width direction thereof.

As mentioned above, a plurality of ink tanks 22 are housed in the casing 21 in the tank unit 20 (FIG. 2). The casing 21 is constituted by a resin hollow box, and the entire back face side thereof is open (FIG. 3). The plurality of ink tanks 22 are arranged in a line in the arrow X direction within the casing 21 (FIG. 2).

A plurality of windows 21*w* are provided on a wall of the casing 21 on the front face side. The plurality of windows 21*w* are provided as through holes that are arranged in the arrow X direction. The windows 21*w* are provided in one-to-one correspondence with the ink tanks 22 such that a part of each ink tank 22 can be seen from the outside of the casing 21. In the printer 10 according to this embodiment, the user can visually check the position of the liquid surface of the ink contained in the ink tanks 22 via the windows 21*w* (details will be described later).

The lid 21*c* is provided in an upper face of the casing 21 (FIG. 2). The lid 21*c* is opened and closed via a hinge mechanism 21*h*. The tank unit 20 is configured such that an upper end of a cylindrical ink injection portion 59, which projects upward from each ink tank 22, is exposed to the outside of the casing 21 when the lid 21*c* is open. The user of the printer 10 can inject ink into each ink tank 22 from the outside of the tank unit 20 by opening the lid 21*c* and removing a cap member 59*c* from the corresponding ink injection portion 59. The details of a configuration of the ink tank 22 will be described later.

In the tank unit 20, the ink tanks 22, a circuit board 23, and a board holding member 24 are integrated to form the internal unit 25 (FIGS. 4 and 5). In the internal unit 25, the ink tanks 22 are arranged in a line in the arrow X direction in a state of being substantially adjacent to one another. A pair of terminal pins 64*a* and 64*b* for electrically detecting ink within each ink tank 22 are attached to the ink tank 22, and a wire harness 65 (hereinafter referred to simply as "harness 65") for electrical connection to the circuit board 23 is attached to these terminal pins 64*a* and 64*b*. The details of the terminal pins 64*a* and 64*b* and the harness 65 will be described later.

The circuit board 23 is arranged on the board holding member 24. The board holding member 24 is installed above the ink tanks 22 thereacross, and is screwed to the ink tanks 22. Thus, the ink tanks 22 are integrally coupled. In the internal unit 25, the circuit board 23 is arranged above the ink tanks 22 with the board holding member 24 therebetween. The circuit board 23 extends in the arrow X direction on the board holding member 24, spanning the ink tanks 22. In this specification, "to extend" means a state of continuously stretching without intermission in a certain direction.

The harness 65 attached to each ink tank 22 is led to the circuit board 23 via a through hole 81 provided in the board holding member 24, and is connected to the circuit board 23 (FIG. 4). The details of a harness wiring method will be described later. Note that a wiring cable 26 is separately connected to the circuit board 23 (FIGS. 3 and 4). The circuit board 23 is also electrically connected to the control unit 32 in the printing unit 30 via this wiring cable 26. In this embodiment, the wiring cable 26 is constituted by a flexible flat cable (FFC).

A3. Configuration of Ink Tank

Figure 6:
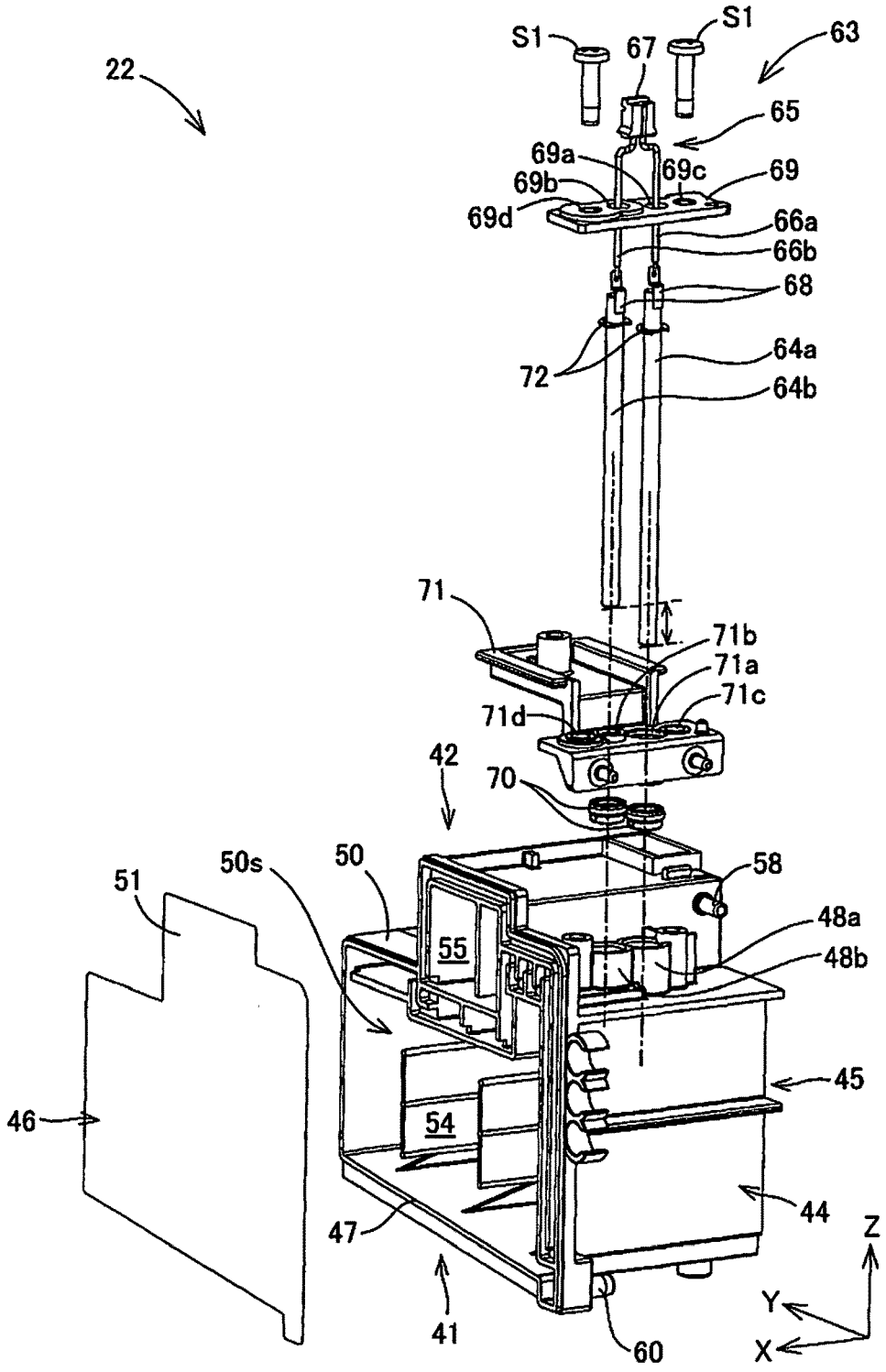
FIG. 6 is a schematic exploded perspective view of an ink tank
Figure 7:
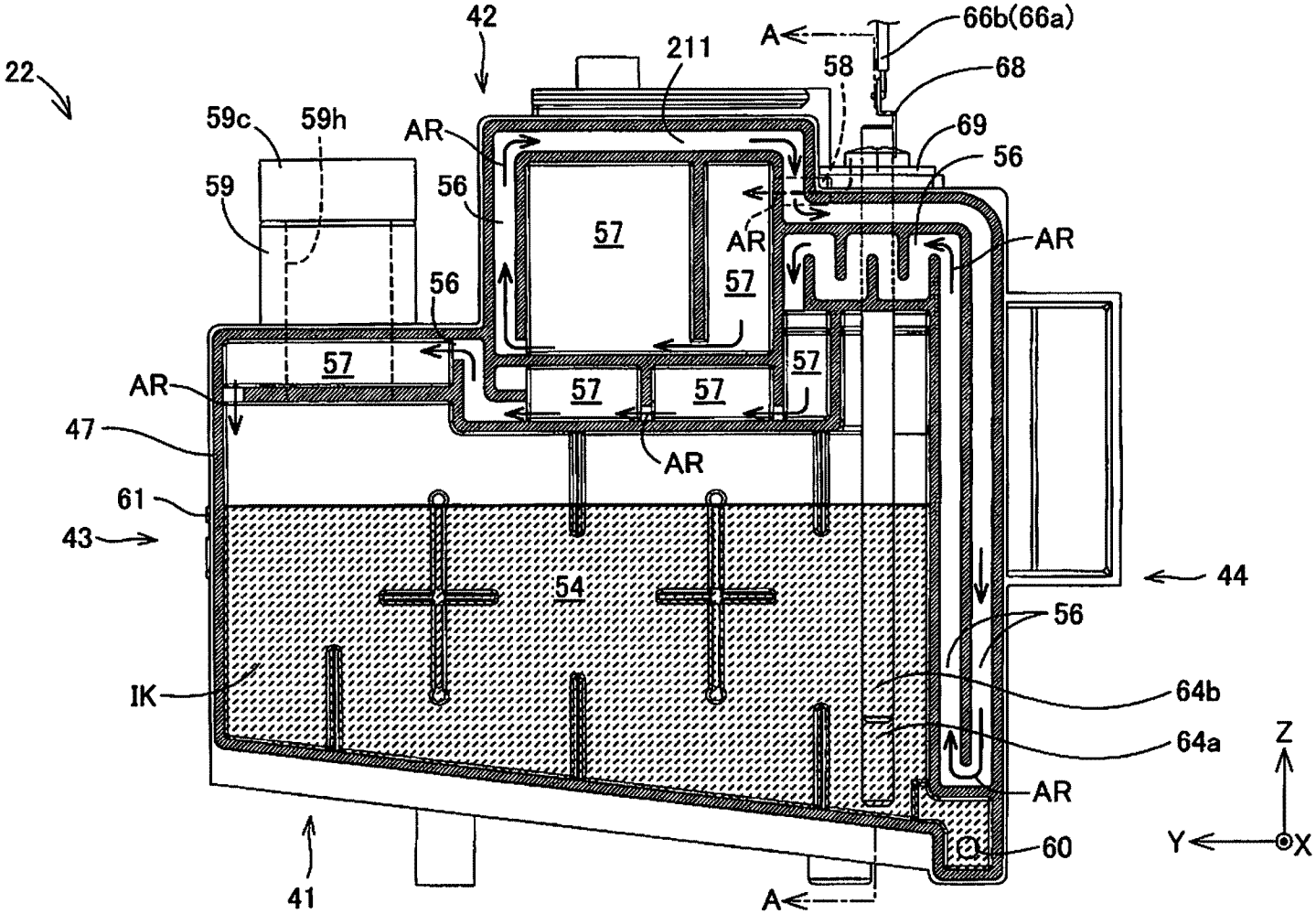
FIG. 7 is a schematic right side view of the ink tank.
Figure 8:
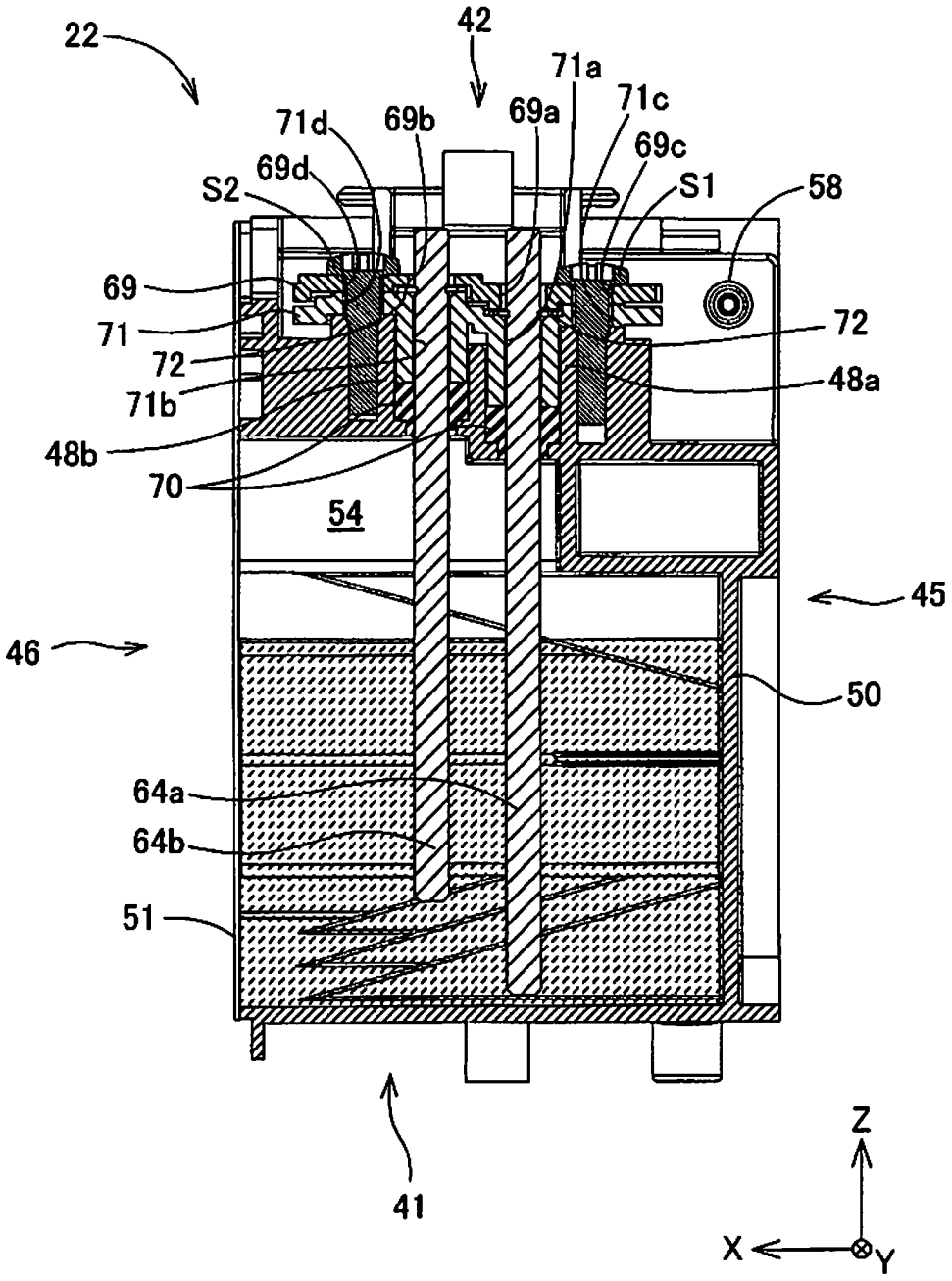
FIG. 8 is a schematic cross-sectional view of the ink tank.

A configuration of the ink tank 22 according to this embodiment will be described with reference to FIGS. 6 to 8. FIG. 6 is a schematic exploded perspective view of the ink tank 22 as viewed from the back face side. FIG. 7 is a schematic right side view of the ink tank 22. FIG. 8 is a schematic cross-sectional view of the ink tank 22 shown in FIG. 7 taken along line A-A. FIGS. 7 and 8 schematically show a state where ink IK is contained in the ink tank 22.

The ink tank 22 is configured to be a hollow container having six faces 41 to 46 (FIGS. 6 and 7). The first face 41 constitutes a bottom face that is oriented downward, and the second face 42 constitutes an upper face that is oriented upward. The third face 43 constitutes a front face that intersects the first face 41 and the second face 42 and is located on the front face side of the tank unit 20. The fourth face 44 constitutes a back face that intersects the first face 41 and the second face 42 and is oriented in a direction opposite to the third face 43, and is oriented toward the printing unit 30 in the printer 10. The fifth face 45 constitutes a left side face that intersects the aforementioned four faces 41 to 44 and is located on the left side when the user directly faces the third face 43. The sixth face 46 constitutes a right side face that intersects the aforementioned four faces 41 to 44 and is located on the right side when the user directly faces the third face 43. Note that, in this embodiment, two faces "intersecting" means one of a state where two faces actually intersect each other, a state where an extended face of one of the faces intersects the other face, and a state where extended faces of the two faces intersect each other. Accordingly, for example, a chamfered portion that forms a curved face or an inclined face may be interposed between two faces that intersect each other, at a corner where these two faces intersect.

A main body of the ink tank 22 is constituted by a case member 50 and a sheet member 51 (FIG. 6). The case member 50 is a hollow box that constitutes the main body of the ink tank 22. The case member 50 on the sixth face 46 side is entirely open in the arrow X direction, and outer walls 47 that surround an internal space 50*s* of the case member 50 constitute the faces excluding the sixth face 46, namely the five faces 41 to 45. The case member 50 is created by integrally molding synthetic resin such as nylon or polypropylene, for example.

The sheet member 51 is a flexible thin-film member, which is joined so as to seal the entire opening of the case member 50 to constitute the sixth face 46 of the ink tank 22 (FIG. 6). The sheet member 51 is constituted by a film member that is made of synthetic resin such as nylon or polypropylene, for example. The sheet member 51 is joined to the case member 50 by means of welding, for example. Note that, in FIG. 7, the sheet member 51 is omitted for the sake of convenience, and a region to which the sheet member 51 is welded is obliquely hatched.

In the ink tank 22, an ink containing portion 54 and an atmosphere introduction portion 55 are formed in the internal space 50*s* surrounded by the case member 50 and the sheet member 51 (FIG. 6). The ink containing portion 54 is a hollow part in which the ink IK can be stored, and has the largest volume of space in the ink tank 22 (FIG. 7). The atmosphere introduction portion 55 constitutes a flow path for introducing the atmosphere (air) from the outside of the ink tank 22 to the ink containing portion 54. In this embodiment, the atmosphere introduction portion 55 is formed in a region above the ink containing portion 54 and a region on the back face side thereof.

The atmosphere introduction portion 55 includes a plurality of atmosphere flow paths 56 and a plurality of atmosphere chambers 57. The plurality of atmosphere flow paths 56 are pipe-like flow paths that are configured as a result of flow path grooves, which are provided so as to face the sheet member 51, being covered by the sheet member 51 in the case member 50 (FIG. 7). The atmosphere flow paths 56 are configured to repeatedly fold back in the arrow Y direction and the arrow Z direction such that the ink IK does not leak to the outside via the atmosphere introduction portion 55 when the ink tank 22 is rotated. The plurality of atmosphere chambers 57 are substantially rectangular parallelepiped hollow parts that are in communication with the atmosphere flow paths 56. The atmosphere chambers 57 each have a larger volume than that of each atmosphere flow path 56 so as to be able to store the ink IK that has flown therein from the ink containing portion 54.

The atmosphere introduction portion 55 is in communication with the outside of the ink tank 22 via an atmosphere intake portion 58. In this embodiment, the atmosphere intake portion 58 is formed as a cylindrical pipe that projects in the direction opposite to the arrow Y at the upper end of the ink tank 22 (FIGS. 6 and 7). The air that is taken in from the atmosphere intake portion 58 flows into the ink containing portion 54 via a route indicated by an arrow AR in FIG. 7.

The ink tank 22 is provided with an ink injection portion 59 for injecting the ink IK into the ink containing portion 54. In this embodiment, the ink injection portion 59 is configured to be a cylindrical part having a through hole 59*h*, which is in communication with the ink containing portion 54. The ink injection portion 59 projects upward from the second face 42 at a position close to the third face 43 such that the user can readily access the ink injection portion 59.

In the tank unit 20, when the lid 21*c* of the casing 21 is opened, the upper end opening of the ink injection portion 59 is exposed to the outside, as mentioned above (FIG. 2). Usually, a cap member 59*c* is airtightly attached to the upper end opening of the ink injection portion 59. The cap member 59*c* is made of a synthetic resin such as nylon or polypropylene, for example. The user of the printer 10 can supply the ink IK to the ink containing portion 54 by removing the cap member 59*c* from the ink injection portion 59.

An ink exit 60 is formed at the lower end of the fourth face 44 of the ink tank 22 (FIGS. 6 and 7). The ink exit 60 is configured to be a cylindrical pipe having a through hole that is in communication with the lower end of the ink containing portion 54, and projects from the lower end of the fourth face 44 from the outer wall 47 of the case member 50 in the direction opposite to the arrow X. The ink exit 60 is connected to the print head 33 (FIG. 1) via a tube (not shown). The ink IK in the ink containing portion 54 is supplied from the ink exit 60 to the print head 33.

In the ink tank 22, a part of or the entire outer wall 47 of the case member 50 that constitutes at least the third face 43 is configured to be transparent or translucent such that the liquid surface of the ink IK in the ink containing portion 54 can be visually checked from the outside (FIG. 6). A window 21*w* is provided in the casing 21 of the tank unit 20 such that this part of the third face 43 can be seen from the outside of the casing 21 (FIG. 2). The user can visually check the amount of ink contained in the ink tank 22 via this window 21*w* when supplying the ink IK to the ink tank 22, for example.

A mark 61 is provided on the wall face of the third face 43 (FIGS. 2 and 7). The mark 61 indicates the upper limit position of the liquid surface of the ink IK in the ink containing portion 54. The mark 61 may be formed as a projection or a recess on the wall face of the third wall 43, or may be formed through printing or by attaching a seal, for example. The window 21*w* of the tank unit 20 is formed such that the mark 61 can be visually checked from the outside of the tank unit 20 (FIG. 2).

A terminal assembly 63 is attached to the ink tank 22 (FIG. 6). The terminal assembly 63 includes the first terminal pin 64*a*, the second terminal pin 64*b*, the harness 65, two connecting members 68, and a fixing member 69. The pair of terminal pins 64*a* and 64*b* included in the terminal assembly 63 are inserted into the ink containing portion 54 from the upper end of the ink tank 22 in the arrow Z direction, and are used for electrically detecting the ink IK in the ink containing portion 54 (details will be described later). In this embodiment, the two terminal pins 64*a* and 64*b* are constituted by cylindrical conductive members that axially extend straight. The terminal pins 64*a* and 64*b* are made of stainless steel, for example. One end of each of the terminal pins 64*a* and 64*b* is arranged within the ink containing portion 54, and the other end of each of the terminal pins 64*a* and 64*b* is arranged outside the ink tank 22 (FIGS. 7 and 8). In the following description, of the two ends of each of the terminal pins 64*a* and 64*b*, the end on the side in a direction opposite to the arrow Z that is arranged within the ink containing portion 54 will be called a "leading end", and the end on the side in the arrow Z direction that is arranged outside the ink tank 22 will be called a "railing end". Note that, in this embodiment, the first terminal pin 64*a* is longer than the second terminal pin 64*b* (FIGS. 6 and 8).

The harness 65 has a first wire 66*a*, a second wire 66*b*, and a connector 67 (FIG. 6). The first wire 66*a* and the second wire 66*b* each have a lead wire that is mainly made of copper or the like. The outer circumference of this wire is covered by an insulating member, such as vinyl. One end of the first wire 66*a* is connected to the trailing end of the first terminal pin 64*a* via the corresponding connecting member 68. Similarly, one end of the second wire 66*b* is also connected to the end of the trailing end of the second terminal pin 64*b* via the corresponding connecting member 68. The connecting members 68 will be described later. The other ends of the first wire 66*a* and the second wire 66*b* are coupled to the connector 67, which is a terminal. The connector 67 is connected to a later-described circuit-side connecting portion 75 that is provided in the circuit board 23.

Thus, in this embodiment, the circuit board 23 and the terminal pins 64*a* and 64*b* used for detecting ink are connected via the connecting members 68 and the wires 66*a* and 66*b* of the harness 65. Accordingly, the electrical connection therebetween being released due to an impact such as vibration occurring in the printer 10 is suppressed. Electrical resistance at electrical contacts for the terminal pins 64*a* and 64*b* is reduced. Thus, in this regard, the connection configuration using the harness 65 and the connecting members 68 according to this embodiment has an advantage in that it is superior to a configuration using spring contacts that are not joined to the terminal pins 64*a* and 64*b* but establish electrical connection using the elasticity of a spring, for example. In this embodiment, the connecting members 68 are arranged below the board holding member 24, and the connection configuration between the harness 65 and the pair of terminal pins 64*a* and 64*b* is protected by the board holding member 24.

The fixing member 69 is a tabular resin member, and is an assisting member that is used for fixing the terminal assembly 63 to the ink tank 22 with two screws S1. The fixing member 69 is provided with a first through hole 69*a* and a second through hole 69*b*, which are arranged next to each other in the arrow X direction. When the tank unit 20 is assembled, the first wire 66*a* of the harness 65 is passed through the first through hole 69*a*, and the second wire 66*b* of the harness 65 is passed through the second through hole 69*b* (details will be described later). The fixing member 69 is also provided with a third through hole 69*c* and a fourth through hole 69*d*, through which the screws S1 are passed, on either side so as to sandwich the first through hole 69*a* and the second through hole 69*b*. The method for assembling the terminal assembly 63 will be described later.

The case member 50 of the ink tank 22 is provided with a first cylindrical portion 48*a* and a second cylindrical portion 48*b* that are substantially cylindrical and project upward, at edge positions dose to the fourth face 44 on the outer wall 47 constituting the second face 42 (FIG. 6). Tubular holes that pass through the center of the first cylindrical portion 48*a* and the second cylindrical portion 48*b* are in communication with the ink containing portion 54 (FIG. 8). The leading end of the first terminal pin 64*a* is inserted into the ink containing portion 54 via the tubular hole of the first cylindrical portion 48*a*. The leading end of the second terminal pin 64*b* is inserted into the ink containing portion 54 via the tubular hole of the second cylindrical portion 48*b*.

In the ink tank 22 according to this embodiment, ring-shaped seal members 70 are arranged at the bottom of the tubular hole of the first cylindrical portion 48*a* and the bottom of the tubular hole of the second cylindrical portion 48*b* (FIGS. 6 and 8). The terminal pins 64*a* and 64*b* are inserted into the ink containing portion 54 through the through holes provided at the center of the seal members 70. The inner circumferential faces of the seal members 70 come into airtight contact with the outer circumferential faces of the terminal pins 64*a* and 64*b*, and the lower ends of the seal members 70 seal the ink containing portion 54 (FIG. 8). In the ink tank 22 according to this embodiment, the airtightness of the ink containing portion 54 is increased by the seal members 70, and the fixability of the terminal pins 64*a* and 64*b* is increased.

In the ink tank 22 according to this embodiment, the terminal assembly 63 is attached to the case member 50 with a base member 71 therebetween (FIG. 6). The base member 71 is a resin assisting member for fixing the terminal assembly 63, and has four through holes 71*a* to 71*d* at positions corresponding to the four through holes 69*a* to 69*b* provided in the fixing member 69 in the terminal assembly 63. When the terminal assembly 63 is attached to the case member 50, two projections that include the through holes 71*a* and 71*b* of the base member 71 are housed in the tubular holes of the first cylindrical portion 48*a* and the second cylindrical portion 48*b*, respectively, so as to be fitted thereto (FIG. 8). Then, the fixing member 69 is stacked onto the base member 71, and one of the screws S1 is inserted into the through hole 71*c* in the base member 71 and the through hole 69*c* in the fixing member 69. Similarly, the other screw S1 is inserted into the through hole 71*d* in the base member 71 and the through hole 69*d* in the fixing member 69.

The terminal pins 64*a* and 64*b* according to this embodiment are each provided with a hook 72 that projects in a flange-like manner in a radial direction that is perpendicular to the center axis direction (FIG. 6). The hook 72 is constituted by an E ring or a C ring that is attached to the main body of each of the terminal pins 64*a* and 64*b*, for example. In the ink tank 22, the terminal pins 64*a* and 64*b* are positioned in the height direction due to the hooks 72 of the terminal pins 64*a* and 64*b* being locked at the periphery of the through holes 71*a* and 71*b* in the base member 71 (FIG. 8). In this embodiment, the height positions of the trailing ends of the terminal pins 64*a* and 64*b* projecting from the case member 50 are substantially the same, whereas the leading end of the first terminal pin 64*a* is located at a lower position than the leading end of the second terminal pin 64*b*. It is desirable that the height positions of the leading ends of the terminal pins 64*a* and 64*b* within the ink containing portion 54 are determined in accordance with the position at which it can be detected that the amount of ink contained in the ink containing portion 54 has reached a given amount. This given amount may be set in accordance with the timing of notifying the user to refill the ink.

A4. Schematic Configuration of Circuit Board

Figure 9:
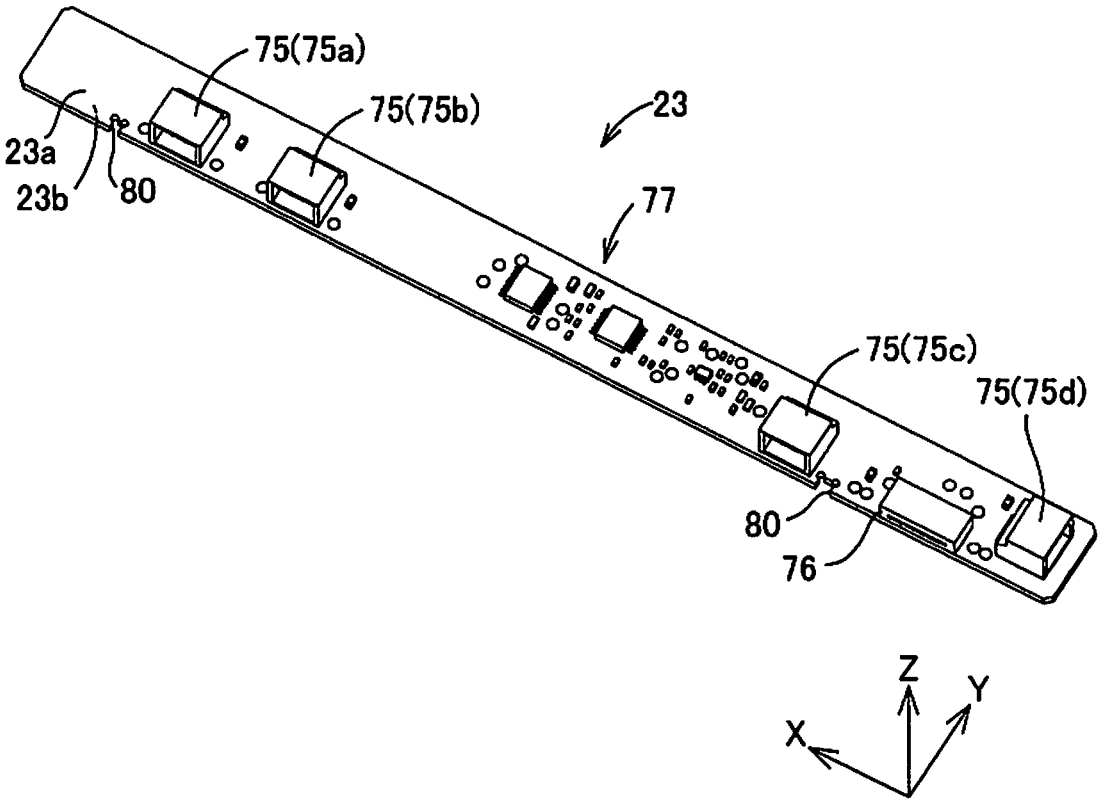
FIG. 9 is a schematic perspective view of a circuit board.
Figure 10:
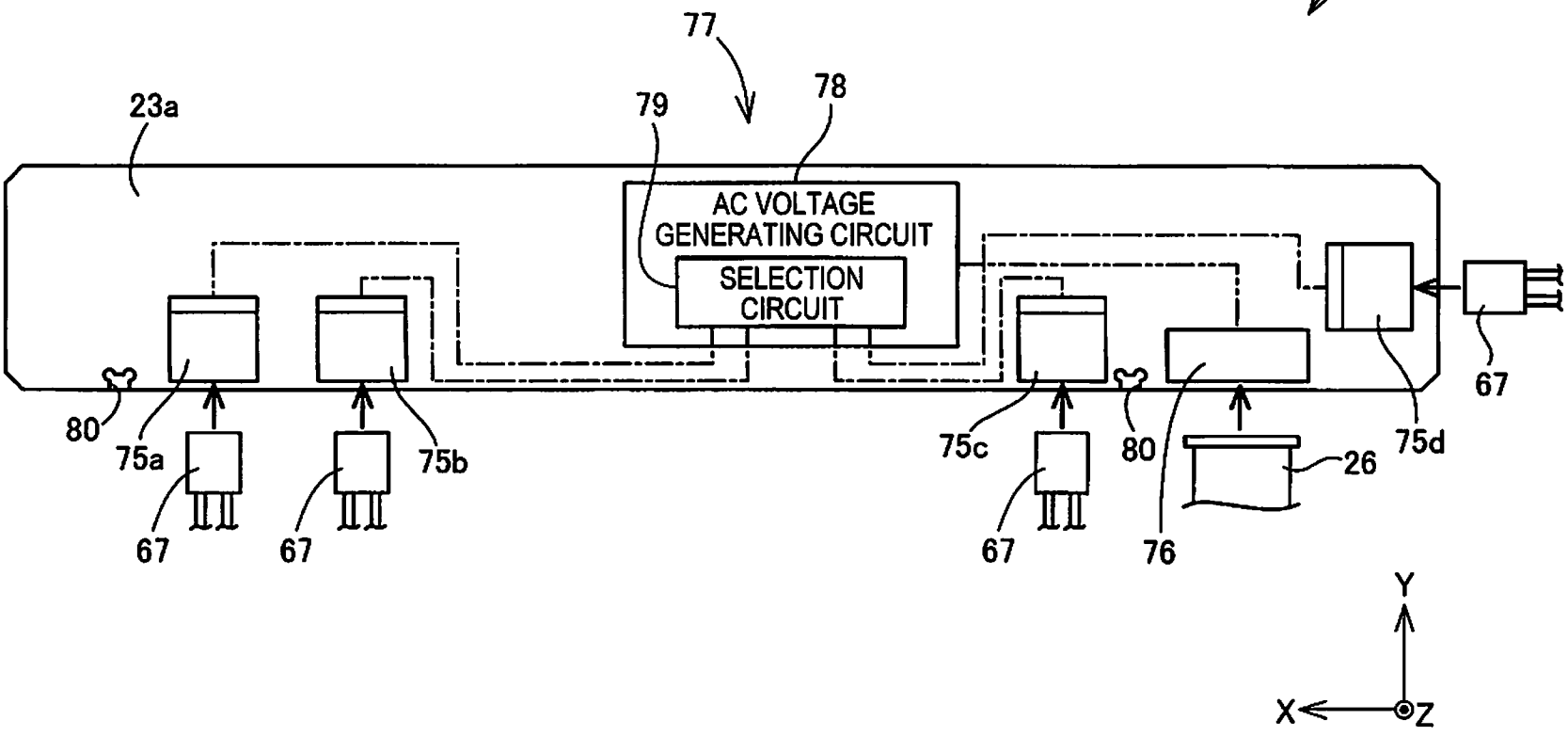
FIG. 10 is a schematic view schematically showing a configuration of the circuit board.

A schematic configuration of the circuit board 23 will be described with reference to FIGS. 9 and 10. FIG. 9 is a schematic perspective view showing a configuration of an external appearance of the circuit board 23. FIG. 10 is a schematic view schematically showing a configuration of the circuit board 23. In FIG. 10, the connectors 67 and the wiring cable 26 that are connected to the circuit board 23 are schematically shown, and electrical connection routes on the circuit board 23 are schematically expressed by alternate long and short dash lines.

The circuit board 23 has a substantially rectangular outline with a longer side in the arrow X direction and a shorter side in the arrow Y direction, and has a first face 23*a*, which is oriented upward in the tank unit 20, and a second face 23*b* on the opposite side. The circuit board 23 is constituted by a printed board made of an insulating resin. The circuit board 23 may be constituted by a hard rigid board, or may be constituted by a pliable flexible printed board. A plurality of circuit-side connecting portions 75, a cable connecting portion 76, and a circuit portion 77 are arranged on the first face 23*a* of the circuit board 23.

The plurality of circuit-side connecting portions 75 are provided in one-to-one correspondence with the plurality of ink tanks 22 included in the tank unit 20. In this embodiment, four circuit-side connecting portions 75 are provided for the four ink tanks 22. In the following description, the four circuit-side connecting portions 75 will be individually called a first circuit-side connecting portion 75*a*, a second circuit-side connecting portion 75*b*, a third circuit-side connecting portion 75*c*, and a fourth circuit-side connecting portion 75*d*, for the purpose of distinction. The connectors 67 in the harnesses 65 attached to the respective ink tanks 22 are connected to the corresponding circuit-side connecting portions 75*a* to 75*d*.

In the tank unit 20, the circuit-side connecting portions 75*a* to 75*d* are arranged above the ink tanks 22 that are connected to the respective circuit-side connecting portions 75*a* to 75*d* (FIG. 4). The connector 67 of the ink tank 22 that is located at the most proximal position as viewed in the direction opposite to the arrow X is connected to the first circuit-side connecting portion 75*a*. The connector 67 of the ink tank 22 that is located second from the proximal side is connected to the second circuit-side connecting portion 75*b*. The connector 67 of the ink tank 22 that is located third from the proximal side is connected to the third circuit-side connecting portion 75*c*. The connector 67 of the ink tank 22 that is located fourth from the proximal side is connected to the fourth circuit-side connecting portion 75*d*.

In the circuit board 23 according to this embodiment, the first circuit-side connecting portion 75*a* and the second circuit-side connecting portion 75*b* are provided at positions close to the end on the side in the arrow X direction (FIGS. 9 and 10). On the other hand, the third circuit-side connecting portion 75*c* and the fourth circuit-side connecting portion 75*d* are provided at positions close to the end on the side in a direction opposite to the arrow X direction. The cable connecting portion 76 is provided between the third circuit-side connecting portion 75*c* and the fourth circuit-side connecting portion 75*d*. The wiring cable 26 for exchanging electrical signals with the control unit 32 in the printing unit 30 is connected to the cable connecting portion 76.

In the circuit board 23 according to this embodiment, the first circuit-side connecting portion 75*a*, the second circuit-side connecting portion 75*b*, and the third circuit-side connecting portion 75*c* are open in the direction opposite to the arrow Y such that the connectors 67 are connected thereto from the arrow Y direction. Similarly, the cable connecting portion 76 is also open in the direction opposite to the arrow Y such that the wiring cable 26 is connected thereto from the arrow Y direction. Meanwhile, the fourth circuit-side connecting portion 75*d* is open in the direction opposite to the arrow X such that the corresponding connector 67 is connected thereto from the arrow X direction at the end on the side in the direction opposite to the arrow X. The reason therefor will be described later.

In the circuit board 23 according to this embodiment, the distance between the second circuit-side connecting portion 75*b* and the third circuit-side connecting portion 75*c* is larger than the distance between the first circuit-side connecting portion 75*a* and the second circuit-side connecting portion 75*b* and the distance between the third circuit-side connecting portion 75*c* and the fourth circuit-side connecting portion 75*d*. The circuit portion 77 is provided in a center region between the second circuit-side connecting portion 75*b* and the third circuit-side connecting portion 75*c*.

In the circuit portion 77, a plurality of circuits having various functions are constituted by a plurality of electronic elements that are collectively arranged in the aforementioned center region. The circuit portion 77 includes an alternating voltage generating circuit 78. The alternating voltage generating circuit 78 generates an alternating voltage that is used for detecting ink in the ink tanks 22. The circuit-side connecting portions 75*a* to 75*d* and the cable connecting portion 76 are electrically connected to the alternating voltage generating circuit 78 in the circuit portion 77 via interconnects that are printed on a surface layer or an internal layer of the main board. The alternating voltage generating circuit 78 includes a selection circuit 79. The alternating voltage generated by the alternating voltage generating circuit 78 is selectively applied to the circuit-side connecting portions 75*a* to 75*d* one-by-one in order by the selection circuit 79. The details of the circuitry of the circuit portion 77 for ink detection and the details of a method for detecting ink in the printer 10 will be described later.

Here, in the circuit board 23 according to this embodiment, the selection circuit 79 is arranged between the second circuit-side connecting portion 75*b* and the third circuit-side connecting portion 75*c*, and is provided in the center region of the circuit board 23 in the longitudinal direction thereof, as mentioned above. Thus, variation in the wiring distances between the selection circuit 79 and the respective circuit-side connecting portions 75*a* to 75*d* is reduced, and the occurrence of an error in the detection of the ink IK due to the installation positions of the circuit-side connecting portions 75*a* to 75*d* is suppressed. In this embodiment, the same number of circuit-side connecting portions 75 is provided on the respective sides of the selection circuit 79. Therefore, these effects can be achieved more significantly. In this embodiment, the circuit-side connecting portions 75*a* to 75*d* are installed on the circuit board 23 so as to be located above the corresponding ink tanks 22 (FIG. 4). Accordingly, the occurrence of variation in the distances between the respective circuit-side connecting portions 75*a* to 75*d* and the corresponding ink tanks 22 is suppressed, and the occurrence of an error in the detection of the ink IK caused by such variation is suppressed.

In addition, the circuit board 23 according to this embodiment is provided with positioning portions 80 for defining the arrangement position of the circuit board 23 on the board holding member 24. The circuit board 23 is provided, in a long side thereof on the side in the direction opposite to the arrow Y, with two recesses that serve as the positioning portions 80 and are locally recessed in the arrow Y direction. The two positioning portions 80 are provided at positions close to respective short sides in the arrow X direction and the direction opposite to the arrow X. Two projections of the board holding member 24 are fitted to the two positioning portions 80.

A5. Schematic Configuration of Board Holding Member

Figure 11:
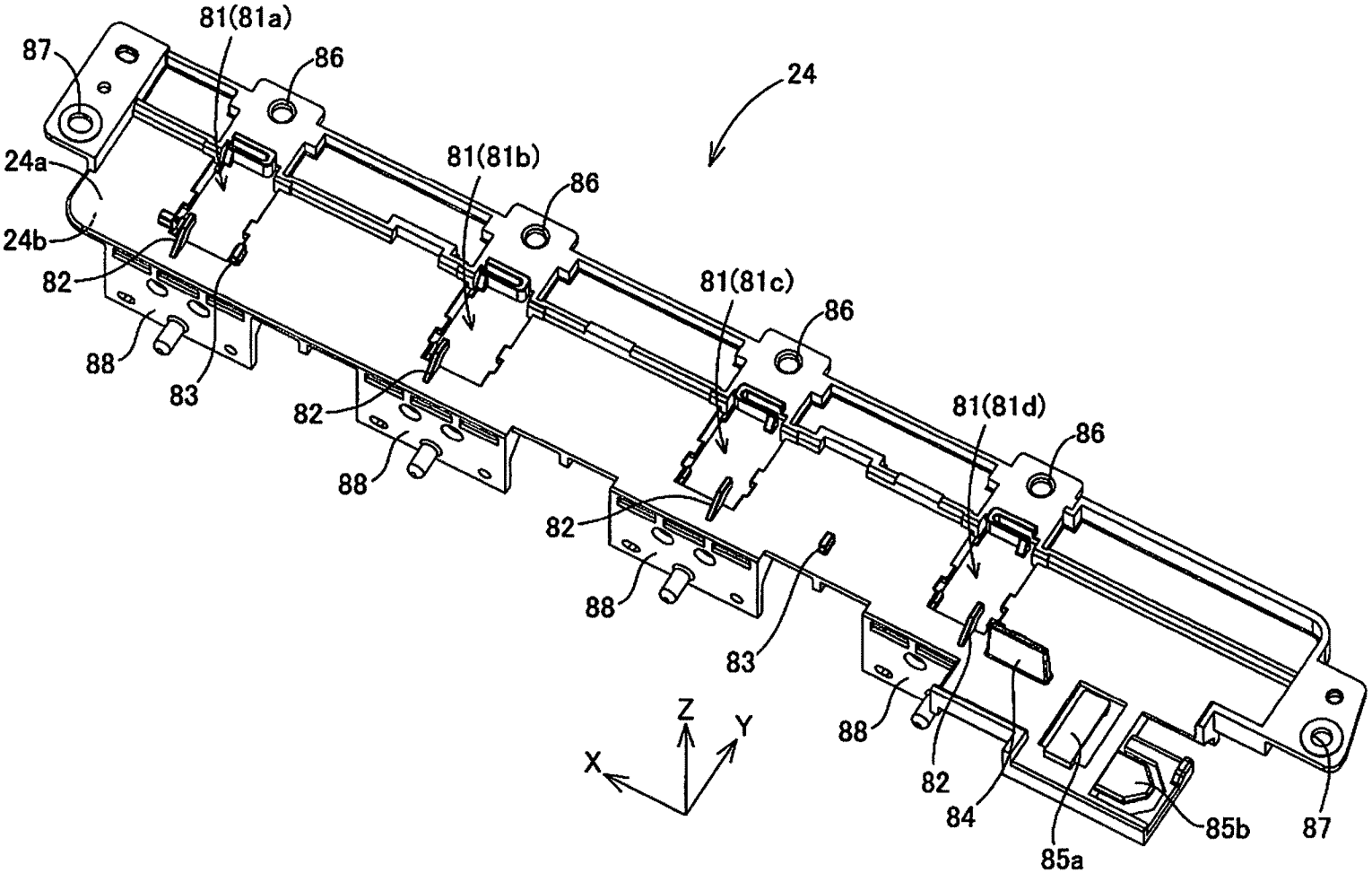
FIG. 11 is a schematic perspective view of a board holding member.

FIG. 11 is a schematic perspective view of the board holding member 24 as viewed from above. The board holding member 24 is a resin tabular member, and has an upper face 24*a* that is oriented upward in the tank unit 20, and a lower face 24*b* that is oriented toward the ink tanks 22 side below. In the board holding member 24, a plurality of through holes 81 are arranged in the arrow X direction in the center part relative to the arrow Y direction. The plurality of through holes 81 are provided in one-to-one correspondence with the plurality of ink tanks 22 included in the tank unit 20. In this embodiment, four through holes 81 are provided for the four ink tanks 22. In the following description, the four through holes 81 will be individually called a first through hole 81*a*, a second through hole 81*b*, a third through hole 81*c*, and a fourth through hole 81*d*, for the purpose of distinction.

In the tank unit 20, the through holes 81*a* to 81*d* are provided above the ink tanks 22 that are connected to the respective through holes 81*a* to 81*d* (FIGS. 4, 5, and 11).

When the board holding member 24 is viewed in the direction opposite to the arrow X, the first through hole 81*a* is located at the most proximal position. The second through hole 81*b* is located at a second position from the proximal side. The third through hole 81*c* is located at a third position from the proximal side. The fourth through hole 81*d* is located at a fourth position from the proximal side. In this embodiment, the through holes 81*a* to 81*d* are each located on the extension of the center axes of the corresponding pair of terminal pins 64*a* and 64*b*. The pair of wires 66*a* and 66*b* of the harness 65 that is attached to each ink tank 22 are led toward the circuit board 23 located above, through a corresponding one of the through holes 81*a* to 81*d*.

Four pawls 82 are provided on the upper face 24*a* of the board holding member 24 according to this embodiment. One pawl 82 is provided for each of the four through holes 81*a* to 81*d*. The pawls 82 project in a pawl-like manner so as to extend toward the respective through holes 81*a* to 81*d* in peripheral parts of the through holes 81*a* to 81*d* on the side in the direction opposite to the arrow Y. The pawls 82 each engage with the circuit board 23 as a result of a leading end thereof riding up onto a long side of the circuit board 23 on the side in the direction opposite to the arrow Y, and fix the circuit board 23 to the board holding member 24. In this embodiment, "to engage" means to engage with an object such that movement of the object in a certain direction is restricted.

Two substantially rectangular parallelepiped projections 83 are provided on the upper face 24*a* of the board holding member 24 according to this embodiment. The projections 83 are provided at positions corresponding to the aforementioned positioning portions 80 of the circuit board 23. When the circuit board 23 is fixed to and held by the board holding member 24, the projections 83 are fitted into the corresponding positioning portions 80. Thus, movement of the circuit board 23 in the arrow X direction and the opposite direction is restricted.

A partition wall 84 is provided on the upper face 24*a* of the board holding member 24 according to this embodiment. The partition wall 84 is provided on the side of the fourth through hole 81*d* in the direction opposite to the arrow X, projects in the arrow Z direction, and extends in the direction opposite to the arrow X. The partition wall 84 has a function of guiding the wiring cable 26 and the pair of wires 66*a* and 66*b* that extend from the fourth through hole 81*d*, and a function of suppressing electrical interference therebetween (details will be described later).

Two tabular parts 85*a* and 85*b* for guiding the wiring cable 26 when led are provided on the side of the partition wall 84 in the direction opposite to the arrow X (FIG. 11). The first tabular part 85*a* is provided adjacent to the partition wall 84. The first tabular part 85*a* horizontally extends in the arrow Y direction. One end of the first tabular part 85*a* on the side in the direction opposite to the arrow Y is coupled and fixed to the main body of the board holding member 24, whereas the other end on the side in the arrow Y direction is not fixed. Thus, the first tabular part 85*a* can elastically undergo bending deformation in the arrow Z direction. A space through which the wiring cable 26 is to be passed downward is formed below the first tabular part 85*a*. When the wiring cable 26 is led, the first tabular part 85*a* presses the wiring cable 26 from above (FIG. 4). The second tabular part 85*b* is provided on the side of the first tabular part 85*a* in the direction opposite to the arrow X, and horizontally extends in the direction opposite to the arrow X (FIG. 11). The wiring cable 26 that has been led from the position of the first tabular part 85*a* toward the second tabular part 85*b* is wound around the second tabular part 85*b*, thereby being folded back in the direction opposite to the arrow Y (FIG. 4).

At an end of the board holding member 24 on the side in the arrow Y direction, a plurality of screw holes 86, which are through holes, are arranged in a line in the arrow X direction. The plurality of screw holes 86 are provided in one-to-one correspondence with the plurality of ink tanks 22 included in the tank unit 20. In this embodiment, four screw holes 86 are provided in correspondence with the four ink tanks 22. The board holding member 24 is screwed to the ink tanks 22 with screws S2 (shown in later-referenced FIG. 17) that are to be passed through the screw holes 86. Two screw holes 87, which are through holes, are provided at both ends of the board holding member 24 in the arrow X direction. The board holding member 24 is screwed to the casing 21 of the tank unit 20 by screws (not shown) that are passed through the screw holes 87.

A plurality of suspended walls 88, which are suspended in the direction opposite to the arrow Z, are provided in the long side of the board holding member 24 on the side in the direction opposite to the arrow Y. The plurality of suspended walls 88 are provided in one-to-one correspondence with the plurality of ink tanks 22 included in the tank unit 20. In this embodiment, four suspended walls 88 are provided in correspondence with the four ink tanks 22. The suspended walls 88 are each formed at a position overlapping the corresponding ink tank 22 when the tank unit 20 is viewed in the arrow Y direction (FIG. 3). More specifically, the suspended walls 88 are each formed at a position overlapping a part in which the harness 65 and the pair of terminal pins 64*a* and 64*b* of the corresponding ink tank 22 are connected. Thus, in the tank unit 20, this connecting part is further protected.

A6. Assembly of Tank Unit and Connection to Printing Unit

Figure 12:
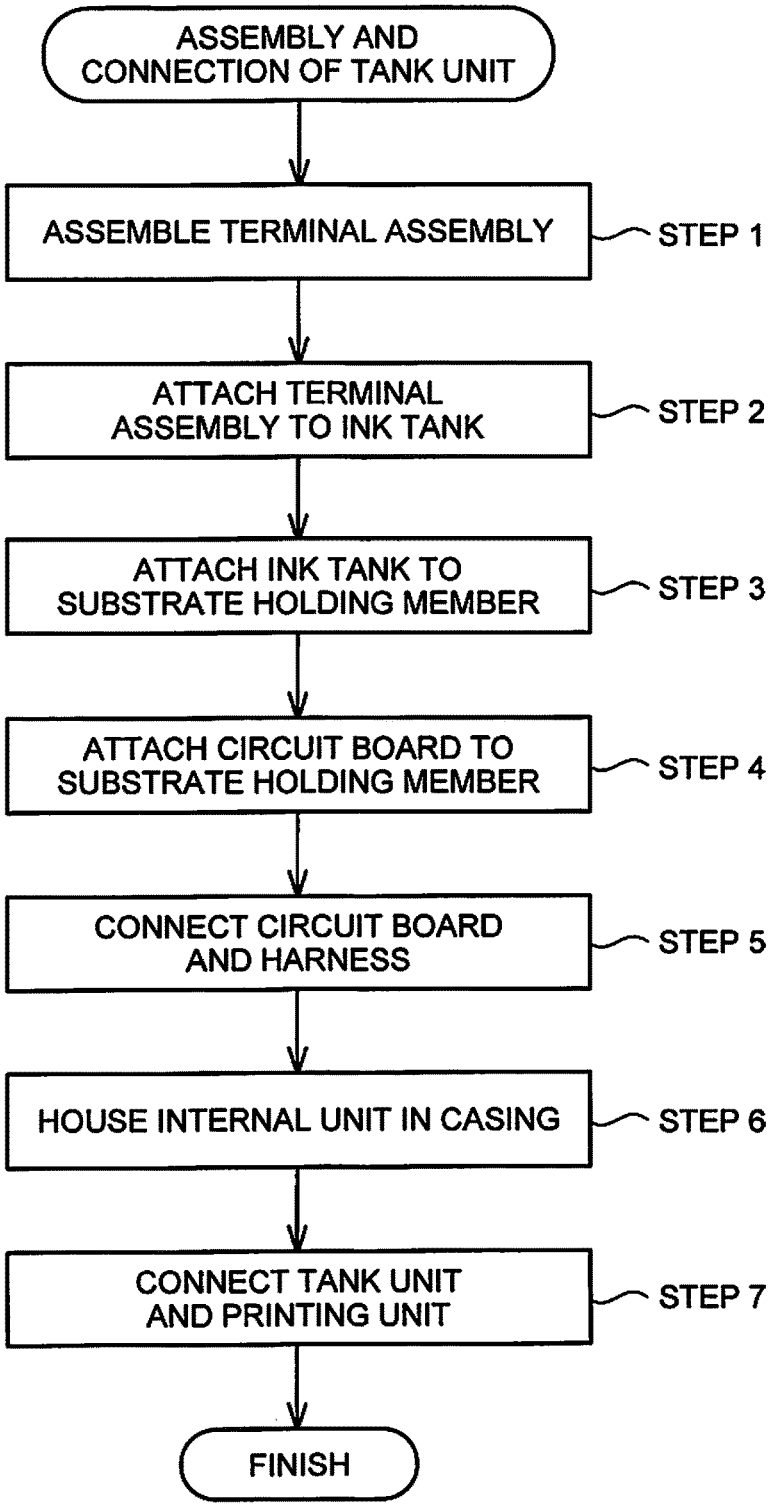
FIG. 12 is a flowchart showing a flow of a process of assembling and connecting the tank unit.

A process of assembling and connecting the tank unit 20 included in the process of manufacturing the printer 10 will be described while sequentially referring to FIGS. 12 to 21. FIG. 12 is a flowchart showing a flow of the process of assembling and connecting the tank unit 20. In a step 1, the terminal assembly 63 is assembled. Specifically, initially, the connecting members 68 are attached to the harness 65. Next, the fixing member 69 is attached to the harness 65, and the pair of terminal pins 64*a* and 64*b* are attached to the harness 65 via the connecting members 68.

Figure 13:
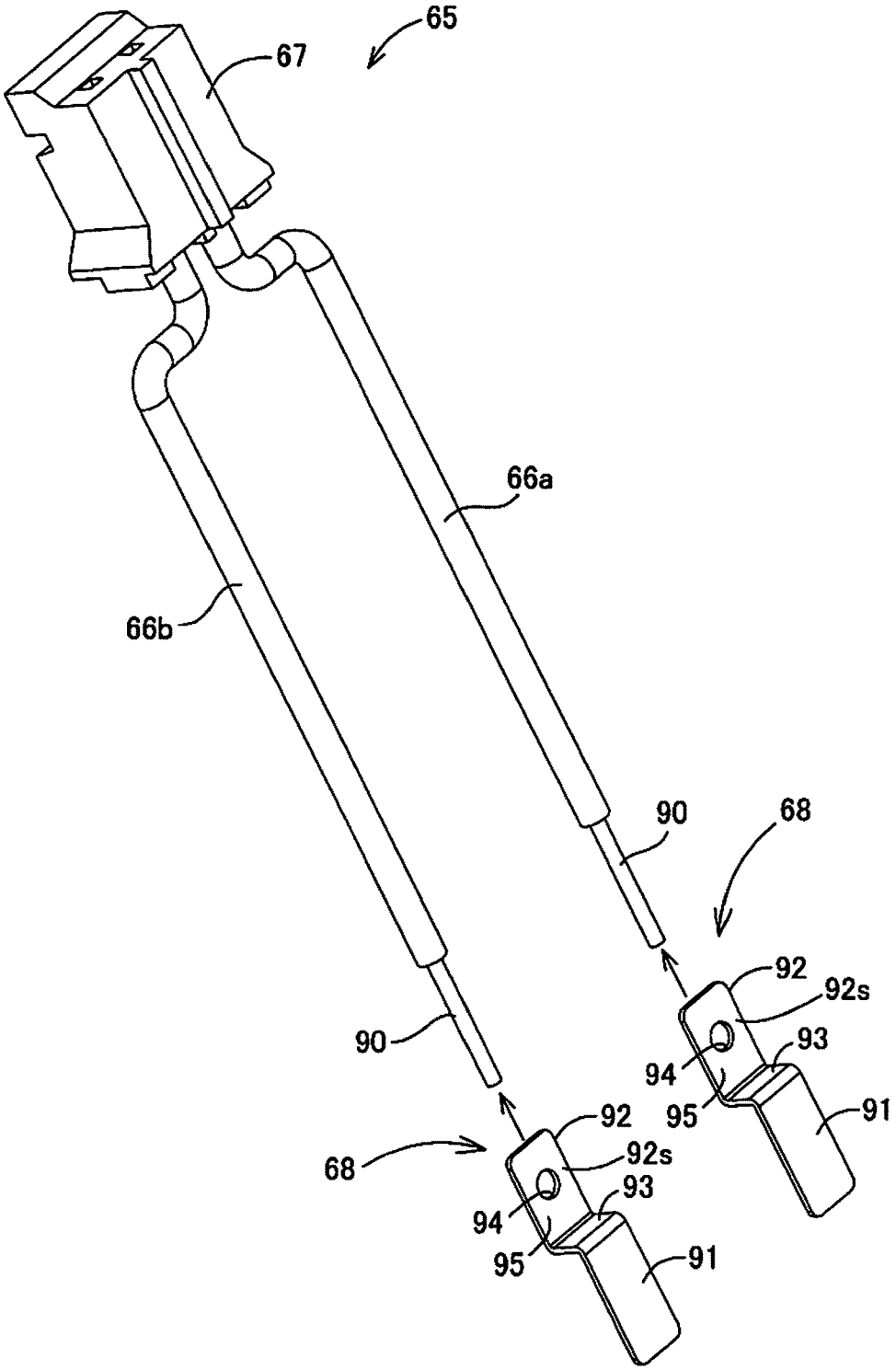
FIG. 13 is a first schematic view showing a step of attaching a connecting member to a harness.
Figure 14:
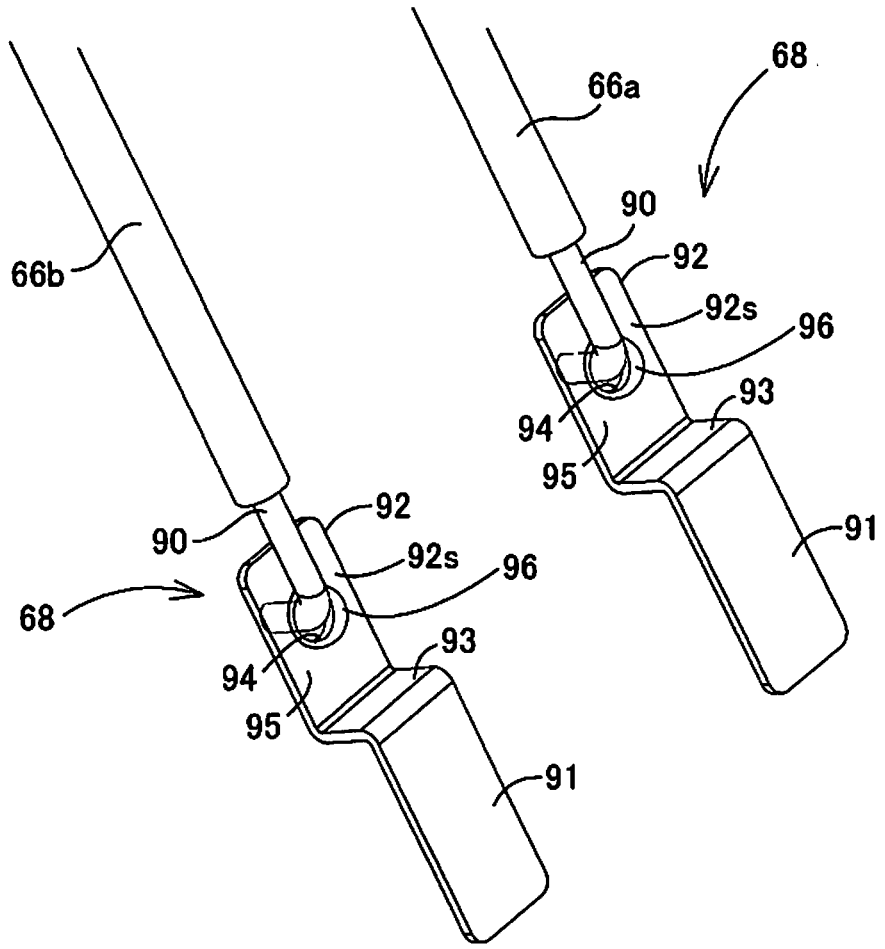
FIG. 14 is a second schematic view showing a step of attaching the connecting member to the harness.

FIGS. 13 and 14 are schematic views showing the step of attaching the connecting members 68 to the harness 65. FIG. 13 shows a state before the connecting members 68 are attached to the harness 65, and FIG. 14 shows a state after the connecting members 68 have been attached to the pair of wires 66*a* and 66*b* of the harness 65.

First, a configuration of the connecting members 68 will be described with reference to FIG. 13. The connecting members 68 are constituted by substantially rectangular metal plates. It is desirable that the connecting members 68 are made of a metallic material whose main component is the same as that of the terminal pins 64*a* and 64*b*. In this specification, "main component" means a material component whose weight ratio is 50% or larger. In this embodiment, the connecting members 68 are made of stainless steel. The connecting members 68 each have a first part 91 that is located at one end in the longitudinal direction, a second part 92 that is located at the other end, and an intermediate part 93 that is located between the first part 91 and the second part 92.

The first part 91 and the second part 92 are substantially parallel to each other, and the intermediate part 93 intersects both the first part 91 and the second part 92 at a substantially right angle. That is to say, the connecting members 68 according to this embodiment have a shape that is folded in a crank-like manner, and a step is formed by the intermediate part 93 interposed between the first part 91 and the second part 92. Note that the first part 91 and the second part 92 may not be strictly parallel to each other, and may be at an arrangement angle at which extended faces thereof intersect each other. The intermediate part 93 need only intersect the first part 91 and the second part 92 so as to form a step between the first part 91 and the second part 92, and may not intersect the first part 91 and the second part 92 strictly at a right angle.

In the connecting members 68, the terminal pins 64*a* and 64*b* are connected to the first parts 91, and the wires 66*a* and 66*b* are connected to the second parts 92. As described later, in this embodiment, the terminal pins 64*a* and 64*b* are welded to the first parts 91. Wires 90 of the wires 66*a* and 66*b* that are exposed from insulating coatings at the leading ends, are soldered to the second parts 92.

In the second part 92 of each connecting member 68, a through hole 94 and a plating layer 95 are formed in order to increase the connectivity of the wires 66*a* and 66*b*. A role of the through hole 94 will be described later. The plating layer 95 is provided such that soldering is facilitated. The plating layer 95 is formed on one face 92*s* of the second part 92. The one face 92*s* is a face that is oriented upward when the connecting member 68 assumes a horizontal installation posture in which the second part 92 is located on the lower side and the first part 91 is located on the upper side. In the following description, this face 92*s* will also be called "plating face 92*s*". In the connecting member 68 according to this embodiment, the plating layer 95 is partially formed, and is not formed in the first part 91 and the intermediate part 93. In this embodiment, the plating layer 95 is formed by placing a gold (Au) plating layer over a nickel (Ni) plating layer. The connecting member 68 according to this embodiment is efficiently manufactured by so-called multi-piece manufacturing. A process of manufacturing the connecting member 68 will be described later.

A step of soldering the wires 66*a* and 66*b* to the connecting members 68 will be described with reference to FIG. 14. In this step, initially, the leading end of the wire 90 of each of the wires 66*a* and 66*b* is inserted into the through hole 94 provided in the second part 92 of the connecting member 68 from the plating face 92*s* side. The wire 90 extending from the through hole 94 to the plating face 92*s* side is folded back in the direction opposite to the first part 91. In this state, a solder 96 is disposed so as to cover the entire through hole 94.

Thus, in this embodiment, the plating layer 95 is formed on the surface layer of the plating face 92*s*, and therefore, the adhesion of the solder 96 to the connecting member 68 is enhanced. The soldering is performed in a state where the wires 90 of the wires 66*a* and 66*b* engage with the through holes 94 of the connecting members 68. Therefore, the joinability of the wires 66*a* and 66*b* to the connecting members 68 is enhanced. Furthermore, in this embodiment, there is a step formed by the intermediate part 93 between the plating face 92*s* and the first part 91. Therefore, the solder 96 being attached to the first part 91 by accident at the time of soldering is suppressed.

Figure 15:
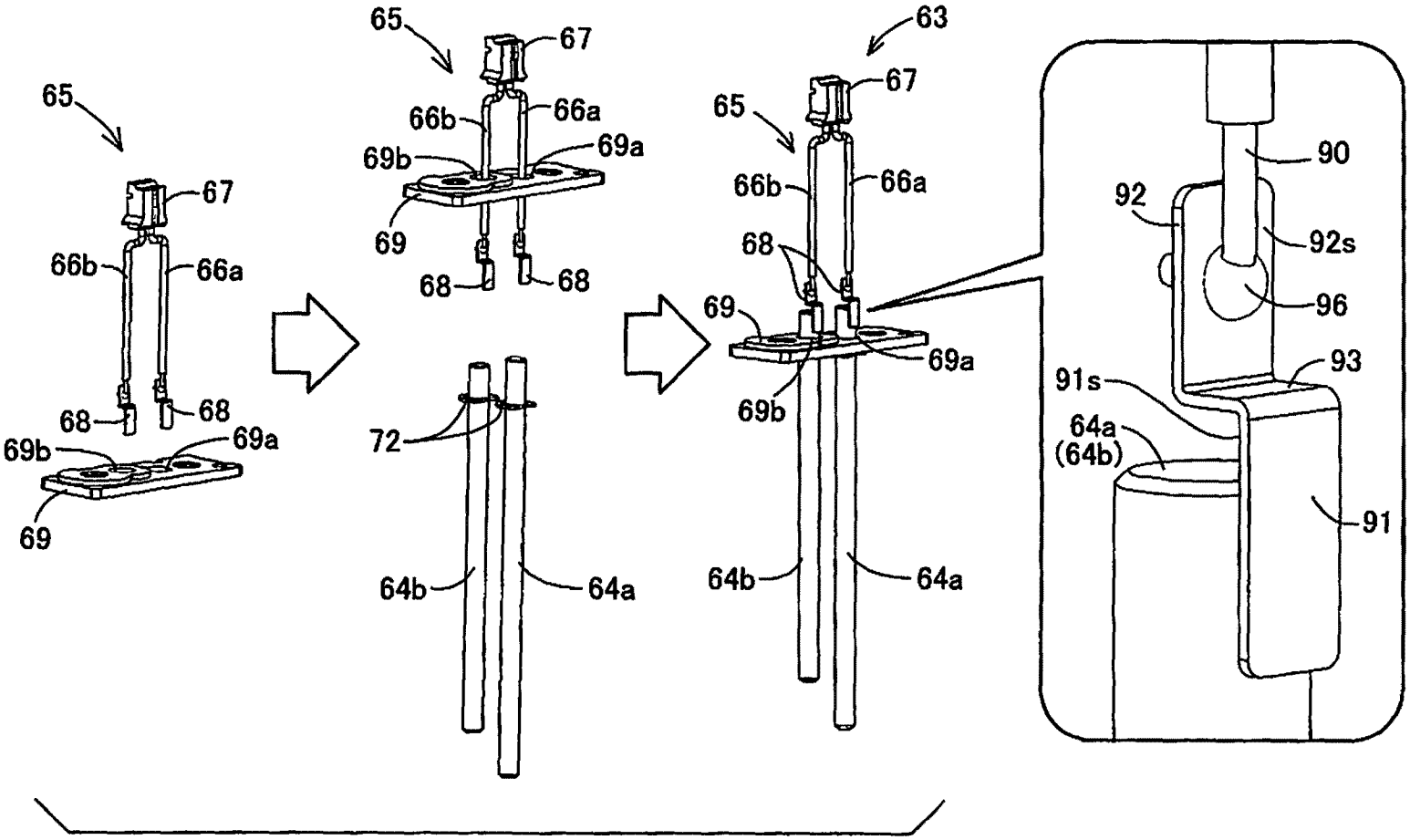
FIG. 15 is a schematic view showing a step of attaching a fixing member to the harness and a step of attaching a pair of terminal pins to the harness.

FIG. 15 is a schematic view showing a step of attaching the fixing member 69 to the harness 65 and a step of attaching the pair of terminal pins 64*a* and 64*b* to the harness 65 in order. In FIG. 15, as indicated by arrows, these steps are sequentially shown from the left to the right of the page.

The fixing member 69 is attached to the harness 65 as a result of the first wire 66*a* to which the connecting member 68 has been attached being passed through the first through hole 69*a*, and the second wire 66*b* to which the connecting member 68 has been attached being passed through the second through hole 69*b*. With the fixing member 69 attached to the harness 65, the terminal pins 64*a* and 64*b* are welded to the first parts 91 of the connecting members 68. The connecting members 68 are attached straight to the trailing ends of the terminal pins 64*a* and 64*b* such that the first part 91 and the second part 92 of each connecting member 68 are arranged in an axial direction that is parallel to the center axes of a corresponding one of the terminal pins 64*a* and 64*b*. Then, the connecting members 68 are welded to the terminal pins 64*a* and 64*b* in faces 91*s* of the first parts 91 that are on the side opposite to the plating faces 92*s* of the second parts 92. In the following description, these faces 91*s* will also be called "joint faces 91*s*". As a result of the welding, melt parts in which the metallic material of which the connecting members 68 are made mixes with the metallic material of which the terminal pins 64*a* and 64*b* are made are formed in the joint faces 91*s*.

In this embodiment, as a result of the connecting members 68 being welded to the terminal pins 64*a* and 64*b* at the joint faces 91*s*, the parts of the second parts 92 that are joined to the wires 66*a* and 66*b* are arranged on the respective axes of the terminal pins 64*a* and 64*b*. That is to say, in this embodiment, the connecting parts of the wires 66*a* and 66*b* are arranged at positions that are distal in the radial direction of the terminal pins 64*a* and 64*b*. Thus, the terminal assembly 63 is assembled more compactly. As a result of these connecting parts not projecting in the radial direction of the terminal pins 64*a* and 64*b*, unexpected contact with the connecting parts or the like is suppressed, and therefore, the connecting parts are highly protected.

In this embodiment, it is desirable that the terminal pins 64*a* and 64*b* are welded to the connecting members 68 by means of resistance welding. In resistance welding, a high current is caused to flow through a welding part at which the tabular first parts 91 of the connecting members 68 and side faces of the terminal pins 64*a* and 64*b* at the trailing ends thereof that form curved faces are in contact with each other. With the connecting member 68 according to this embodiment, a high current can be caused to flow intensively through one welding part having a small contact area in resistance welding. Accordingly, the joint strength between the connecting members 68 and the terminal pins 64*a* and 64*b* can be increased. Note that the method for welding the terminal pins 64*a* and 64*b* to the connecting members 68 is not limited to resistance welding, and may be any other method. For example, the welding may be performed by means of laser welding. In this case as well, since connecting parts are not dispersed, a similar effect can be achieved.

After the terminal pins 64*a* and 64*b* are attached to the harness 65, the fixing member 69 is locked at the hooks 72 of the terminal pins 64*a* and 64*b*, and therefore, the fixing member 69 coming off from the harness 65 is suppressed. As described above, after the terminal assembly 63 is assembled, in a step 2, this terminal assembly 63 is attached to each ink tank 22 (FIG. 12).

Figure 16:
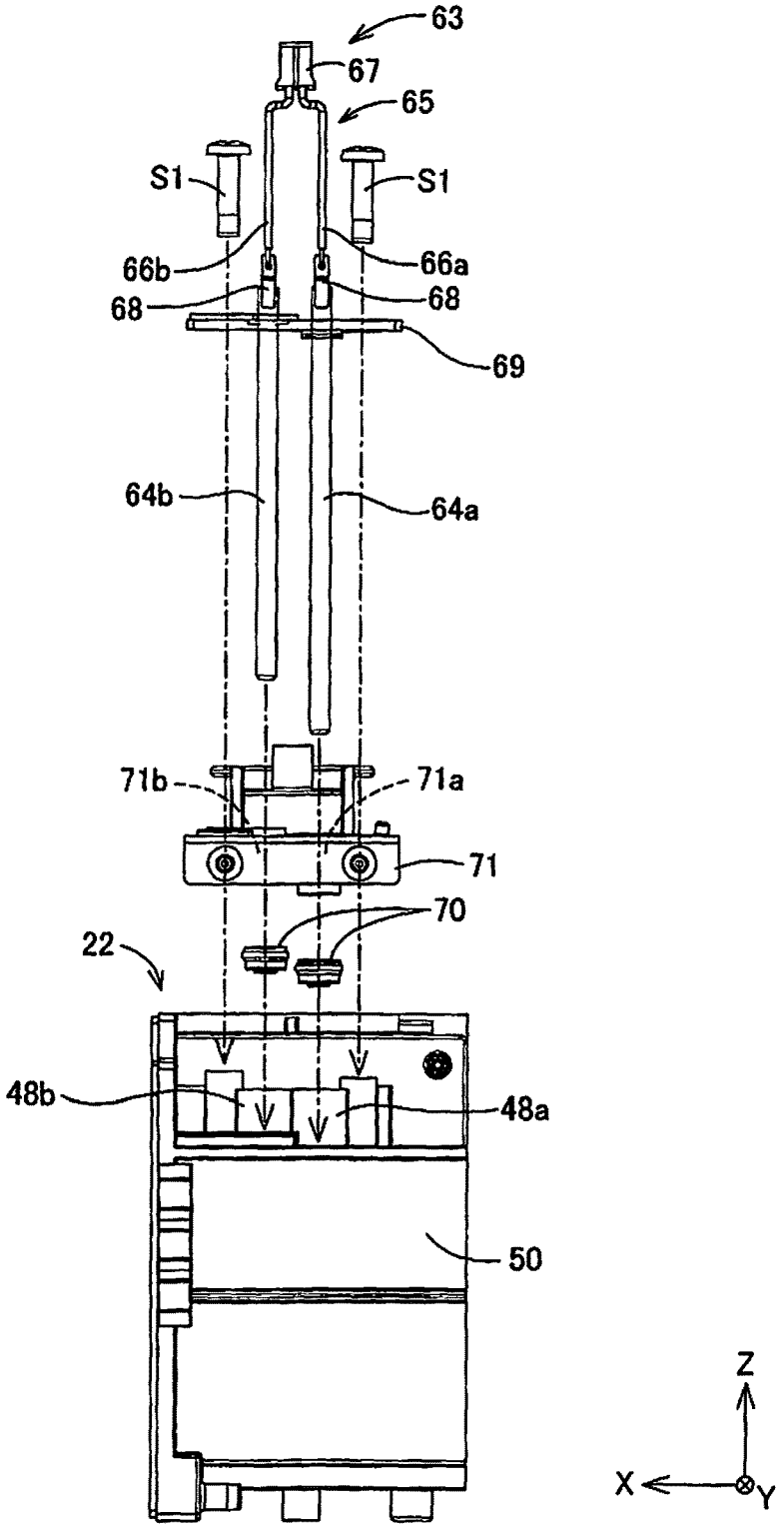
FIG. 16 is a schematic view showing a step of attaching a terminal assembly to the ink tank.

FIG. 16 is a schematic view showing a step of attaching the terminal assembly 63 to each ink tank 22 in the step 2. In the step 2, initially, the seal members 70 are arranged into the tubular hole in the first cylindrical portion 48*a* and the tubular hole in the second cylindrical portion 48*b* of the ink tank 22, and the base member 71 is attached to the first cylindrical portion 48*a* and the second cylindrical portion 48*b*. Then, the first terminal pin 64*a* is inserted into the tubular hole in the first cylindrical portion 48*a* via the first through hole 71*a* in the base member 71, and the second terminal pin 64*b* is inserted into the tubular hole in the second cylindrical portion 48*b* via the second through hole 71*b* in the base member 71. Subsequently, the fixing member 69 is stacked onto the base member 71, the fixing member 69 and the base member 71 are screwed to each other with the two screws S1, and the step of attaching the terminal assembly 63 to each ink tank 22 is finished. In a following step 3, the ink tanks 22 are attached to the board holding member 24, and in a step 4, the circuit board 23 is attached to the board holding member 24 (FIG. 12).

Figure 17:
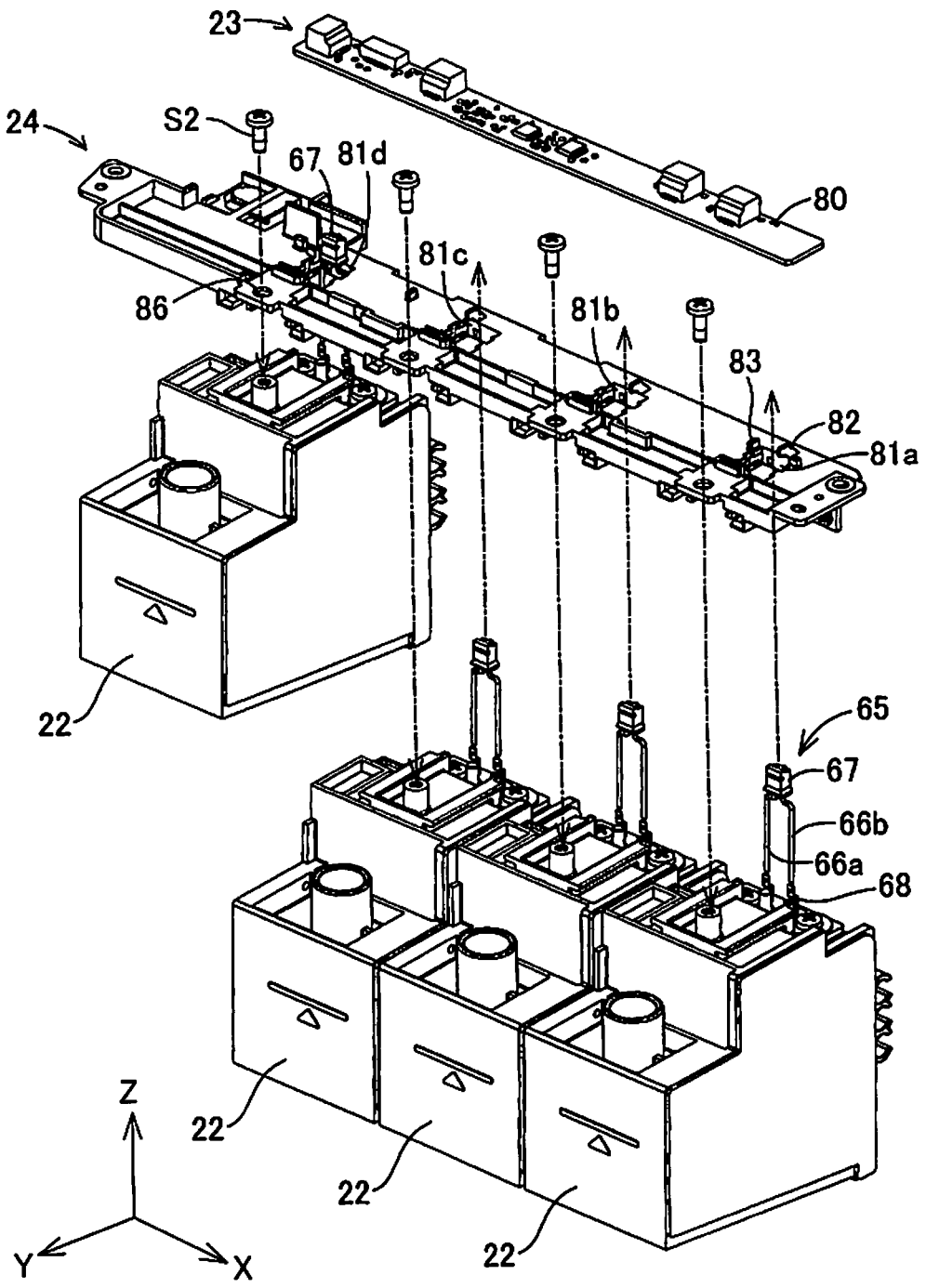
FIG. 17 is a schematic view showing a step of attaching the ink tank to the board holding member and a step of attaching the circuit board to the board holding member.

FIG. 17 is a schematic view showing the step of attaching the ink tanks 22 to the board holding member 24 and the step of attaching the circuit board 23 to the board holding member 24. In the step 3, the board holding member 24 is attached from above the ink tanks 22. At this time, the pair of wires 66*a* and 66*b* of the harness 65 attached to each ink tank 22 is passed through the corresponding through hole 81 in the board holding member 24 and are drawn out from the lower face 24*b* side to the upper face 24*a* side. Then, the screws S2 are passed through the screw holes 86 in the board holding member 24, and the board holding member 24 is screwed to the ink tank 22. Thus, the ink tanks 22 are coupled in a state of being arranged in a line. In the step 4, the circuit board 23 is attached to the board holding member 24. At this time, the circuit board 23 is positioned as a result of the projections 83 fitting to the corresponding positioning portions 80 in the circuit board 23. The circuit board 23 is fixed to the board holding member 24 as a result of the plurality of pawls 82 engaging with the board holding member 24. In a step 5, the harness 65 of each ink tank 22 is connected to the circuit board 23 (FIG. 12).

Figure 18:
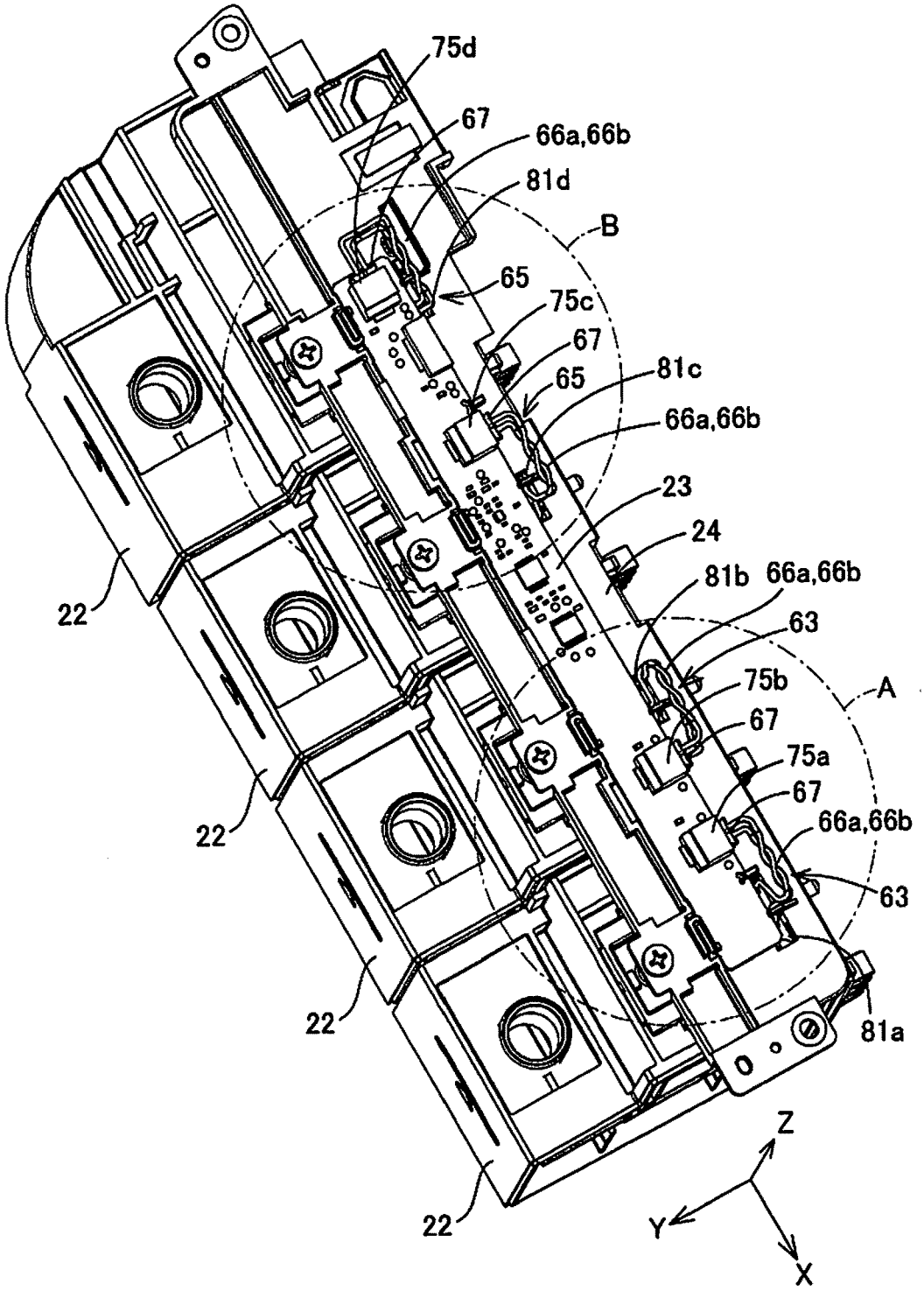
FIG. 18 is a first schematic view showing a step of connecting the harness to the circuit board.
Figure 19:
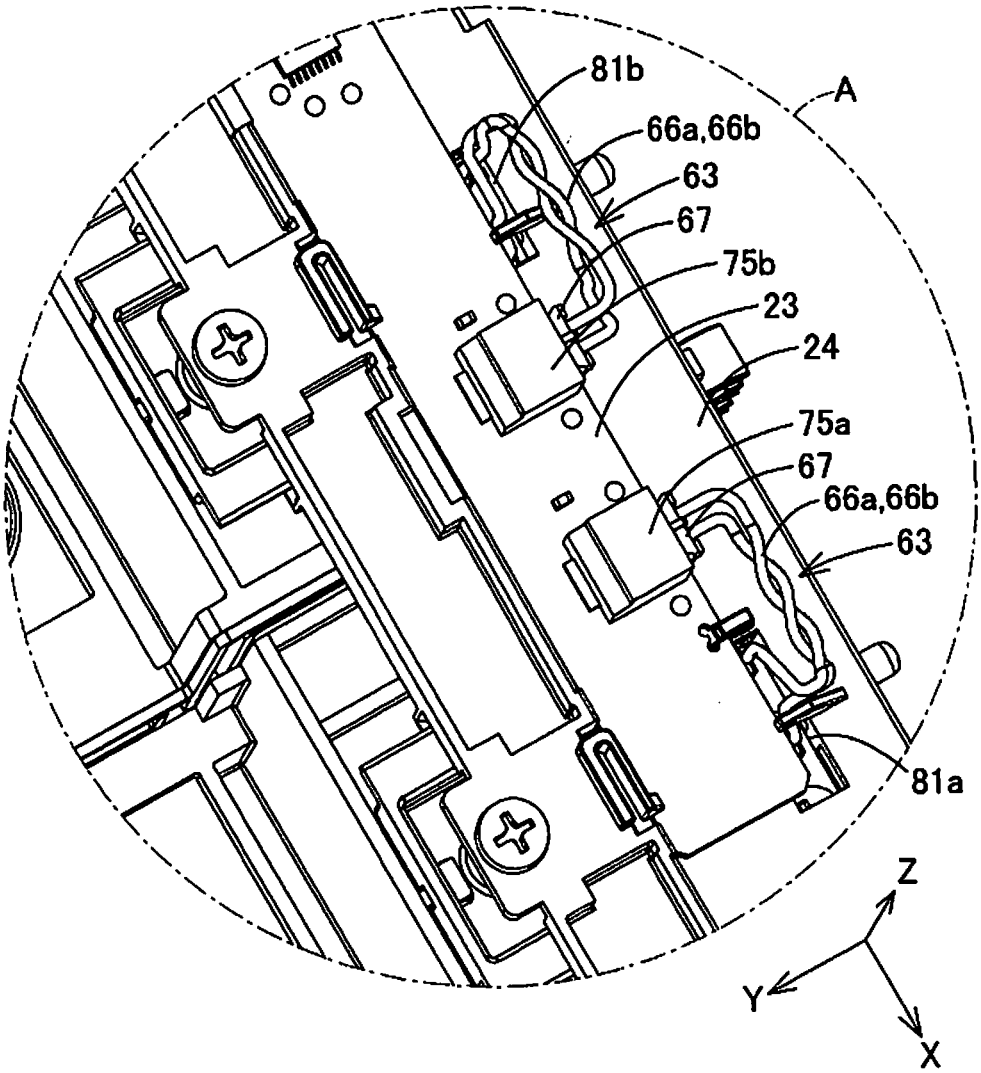
FIG. 19 is a second schematic view showing a step of connecting the harness to the circuit board.
Figure 20:
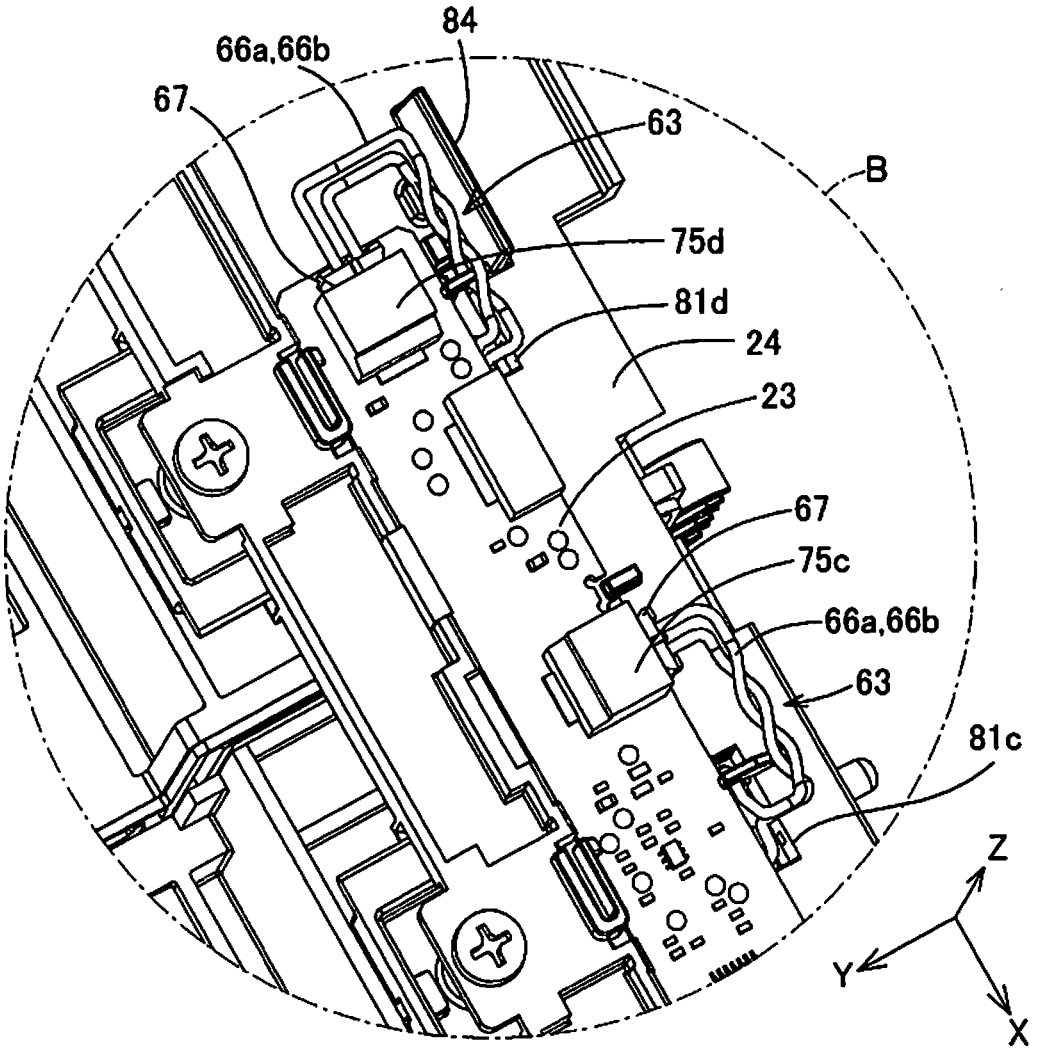
FIG. 20 is a third schematic view showing a step of connecting the harness to the circuit board.

The step of connecting the harness 65 to the circuit board 23 will be described with reference to FIGS. 18 to 20. FIG. 18 shows a state after the connector 67 of each harness 65 has been connected to the corresponding circuit-side connecting portion 75 in the circuit board 23. In FIG. 19, a surrounding region A of the first circuit-side connecting portion 75*a* and the second circuit-side connecting portion 75*b* shown in FIG. 18 is extracted. In FIG. 20, a surrounding region B of the third circuit-side connecting portion 75*c* and the fourth circuit-side connecting portion 75*d* shown in FIG. 18 is extracted.

The connector 67 of the harness 65 that has passed through the first through hole 81*a* in the board holding member 24 is connected to the first circuit-side connecting portion 75*a* (FIGS. 18 and 19). The connector 67 of the harness 65 that has passed through the second through hole 81*b* in the board holding member 24 is connected to the second circuit-side connecting portion 75*b*. The connector 67 of the harness 65 that has passed through the third through hole 81*c* in the board holding member 24 is connected to the third circuit-side connecting portion 75*c* (FIGS. 18 and 20). The connector 67 of the harness 65 that has passed through the fourth through hole 81*d* in the board holding member 24 is connected to the fourth circuit-side connecting portion 75*d*.

In this embodiment, the wires 66*a* and 66*b* of each harness 65 pass through a corresponding one of the through holes 81*a* to 81*d* in the board holding member 24 and are led to the circuit board 23. Accordingly, the wires 66*a* and 66*b* do not need to be led around an outer-peripheral portion of the board holding member 24, and therefore, the wires 66*a* and 66*b* can be led without applying a redundant load to the wires 66*a* and 66*b*, and the wires 66*a* and 66*b* can be wired compactly. The wires 66*a* and 66*b* can be kept on the board holding member 24. Therefore, the occurrence of a malfunction, such as the wires 66*a* and 66*b* being hooked onto something and pulled thereby, as a result of some kind of external force being applied to the wires 66*a* and 66*b* or the connecting parts thereof is suppressed.

In this embodiment, there are gaps that are formed as a result of the circuit board 23 not entirely overlapping the through holes 81*a* to 81*d*, as viewed in the direction opposite to the arrow Z, and the wires 66*a* and 66*b* can be extended from these gaps. Accordingly, in the connection step, the load applied to the wires 66*a* and 66*b* can be reduced.

In this embodiment, when viewed in the direction opposite to the arrow Z, the circuit-side connecting portions 75*a* to 75*c* to which the connectors 67 are connected from the direction opposite to the arrow Y are located at positions shifted from center axes of the respective terminal pins 64*a* and 64*b*, and are provided at positions shifted in the arrow X direction or the direction opposite to the arrow X relative to the respective through holes 81*a* to 81*c*. For this reason, when the harnesses 65 are connected, the respective wires 66*a* and 66*b* are led from positions shifted relative to the direction of the connection to the circuit-side connecting portions 75*a* to 75*c*. More specifically, the wires 66*a* and 66*b* are drawn out from the respective through holes 81*a* to 81*c*, and are thereafter led in the arrow X direction or the direction opposite to the arrow X and led toward the corresponding circuit-side connecting portions 75. Thus, the connectors 67 of the harnesses 65 can be smoothly connected to the corresponding circuit-side connecting portions 75*a* to 75*c* while allowing slack in the wires 66*a* and 66*b*. Therefore, the load applied to the wires 66*a* and 66*b* is reduced. The fourth circuit-side connecting portion 75*d* can also achieve a similar effect as follows.

The corresponding connector 67 is connected to the fourth circuit-side connecting portion 75*d* from the direction opposite to the arrow X. The fourth through hole 81*d* corresponding to the fourth circuit-side connecting portion 75*d* is located on the side of the fourth circuit-side connecting portion 75*d* in the direction opposite to the arrow Y, and is open at a position shifted from the direction of the connection to the fourth circuit-side connecting portion 75*d*. For this reason, the wires 66*a* and 66*b* that have been drawn out from the fourth through hole 81*d* are first guided in the direction opposite to the arrow X, and are thereafter turned in the arrow X direction and is led toward the fourth circuit-side connecting portion 75*d*. Thus, the connector 67 of the harness 65 can be smoothly connected to the fourth circuit-side connecting portion 75*d* while allowing slack in the wires 66*a* and 66*b*, and the load applied to the wires 66*a* and 66*b* is reduced. In addition, as a result of the fourth circuit-side connecting portion 75*d* located at the end of the circuit board 23 on the side in the direction opposite to the arrow X being open in the direction opposite to the arrow X, a region around this end of the circuit board 23 can be effectively used as a space for leading the wires 66*a* and 66*b* that are to be connected to the fourth circuit-side connecting portion 75*d*. Note that the wires 66*a* and 66*b* of the harness 65 that are to be connected to the fourth circuit-side connecting portion 75*d* are arranged along the partition wall 84 provided in the board holding member 24. Thus, for example, the arrangement positions of the wires 66*a* and 66*b* being disturbed or a redundant external force being applied to the wires 66*a* and 66*b* is suppressed.

In addition, in this embodiment, in the pair of the first circuit-side connecting portion 75*a* and the second circuit-side connecting portion 75*b* that are adjacent to each other in a relatively short distance, the wires 66*a* and 66*b* connected to the respective circuit-side connecting portions 75 are led in separating directions. More specifically, the wires 66*a* and 66*b* connected to the first circuit-side connecting portion 75*a* are wired in the arrow X direction, and the wires 66*a* and 66*b* connected to the second circuit-side connecting portion 75*b* are wired in the direction opposite to the arrow X. The same applies to the pair of the third circuit-side connecting portion 75*c* and the fourth circuit-side connecting portion 75*d* that are adjacent to each other in a relatively short distance. Thus, the occurrence of entanglement of the wires 66*a* and 66*b* or electrical interference among the harnesses 65 connected to the two circuit-side connecting portions 75 that are provided in a relatively short distance is suppressed. In this embodiment, the wires 66*a* and 66*b* of each harness 65 are led in a state of being twisted around each other. Thus, the management of the wires 66*a* and 66*b* is facilitated.

The internal unit 25 of the tank unit 20 is configured (FIG. 4) through the above steps 1 to 5 (FIG. 12). In a step 6, the internal unit 25 is housed in the casing 21 and is screwed thereto. Thus, the tank unit 20 is finished (FIG. 3). Thereafter, in a step 7, the circuit board 23 in the tank unit 20 and the control unit 32 (FIG. 1) in the printing unit 30 are electrically connected via the wiring cable 26.

Figure 21:
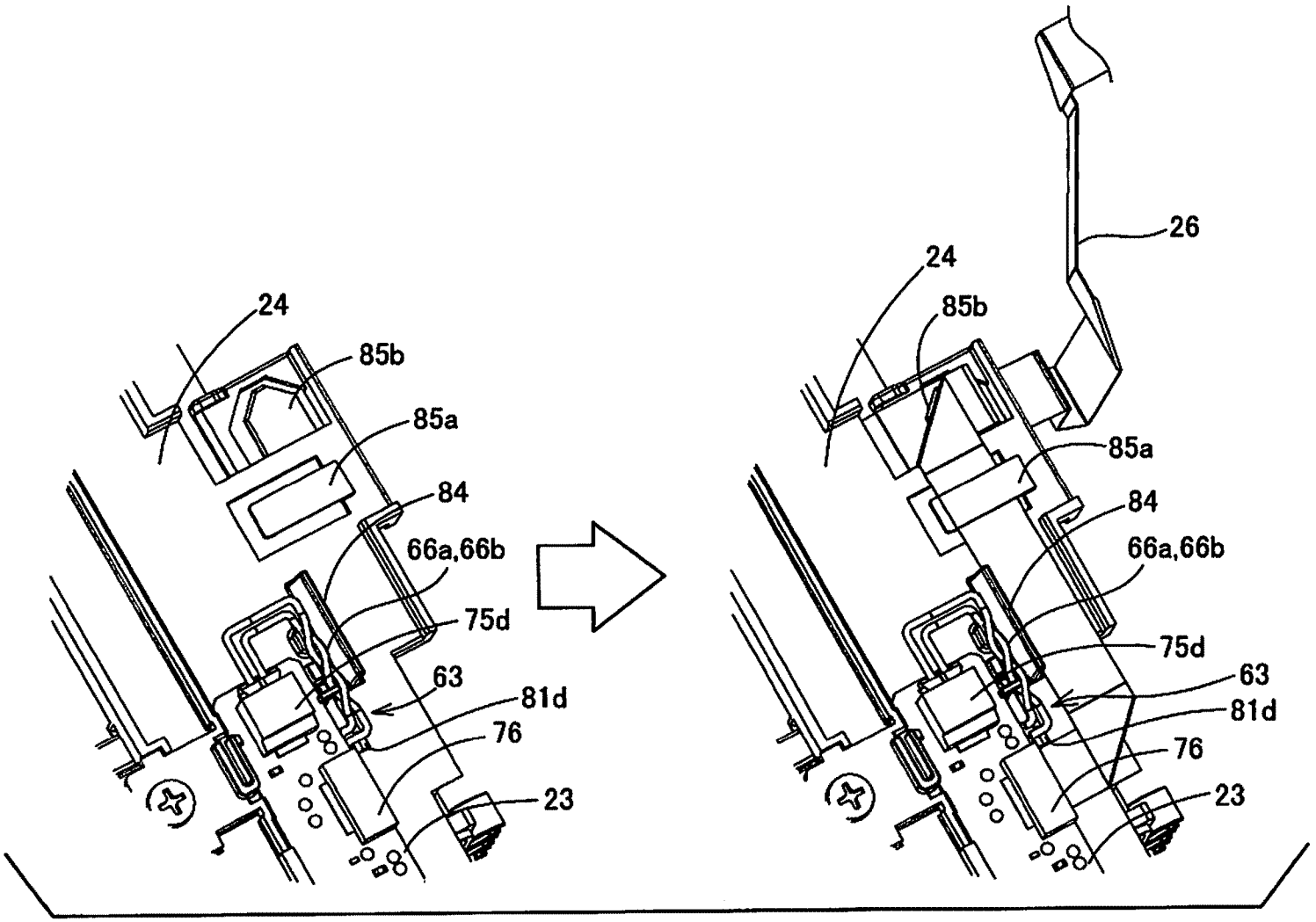
FIG. 21 is a schematic view for illustrating a step of connecting the wiring cable to the circuit board.

FIG. 21 is a schematic view for illustrating the step of connecting the wiring cable 26 to the circuit board 23. In FIG. 21, a region near the cable connecting portion 76 in the internal unit 25 before the wiring cable 26 is connected is extracted on the left side of the arrow, and the same region after the wiring cable 26 is connected is shown on the right side of the arrow. In the step 7, the wiring cable 26 is drawn in from the opening on the back side of the casing 21 into the internal unit 25, and is connected to the cable connecting portion 76 in the arrow Y direction. At this time, the wiring cable 26 is initially wound around the second tabular part 85*b* from the arrow Y direction, and is led in the arrow X direction. Then, the wiring cable 26 is guided downward of the first tabular part 85*a*, and is guided to the cable connecting portion 76 along the partition wall 84 while being locked by the first tabular part 85*a*.

In this embodiment, the cable connecting portion 76 to which the wiring cable 26 is connected is attached to the circuit board 23 so as to be open in the direction opposite to the arrow Y. For this reason, even if the internal unit 25 is in a state of being housed in the casing 21, the wiring cable 26 can be readily connected to the cable connecting portion 76. In this embodiment, the fourth circuit-side connecting portion 75*d* located next to the cable connecting portion 76 is open in the direction opposite to the arrow X, unlike the cable connecting portion 76. Thus, interference between the wiring route of the wiring cable 26 and the wiring routes of the wires 66*a* and 66*b* of the harness 65 connected to the fourth circuit-side connecting portion 75*d* is suppressed.

In this embodiment, the wiring cable 26 and the wires 66*a* and 66*b* of the harness 65 connected to the fourth circuit-side connecting portion 75*d* are arranged parallel to each other, with the partition wall 84 provided in the board holding member 24 therebetween. Thus, electric interference between the wiring cable 26 and the wires 66*a* and 66*b* is suppressed. In addition, in this embodiment, the wiring cable 26 is guided and held by the first tabular part 85*a* and the second tabular part 85*b*, as mentioned above. Therefore, even if the wiring cable 26 is pulled to the outside of the casing 21, its connection to the cable connecting portion 76 being released is suppressed.

The tank unit 20 is assembled and is electrically connected to the printing unit 30 through the above steps, and the printer 10 is finished.

A7. Connecting Member Manufacturing Method

Figure 22:
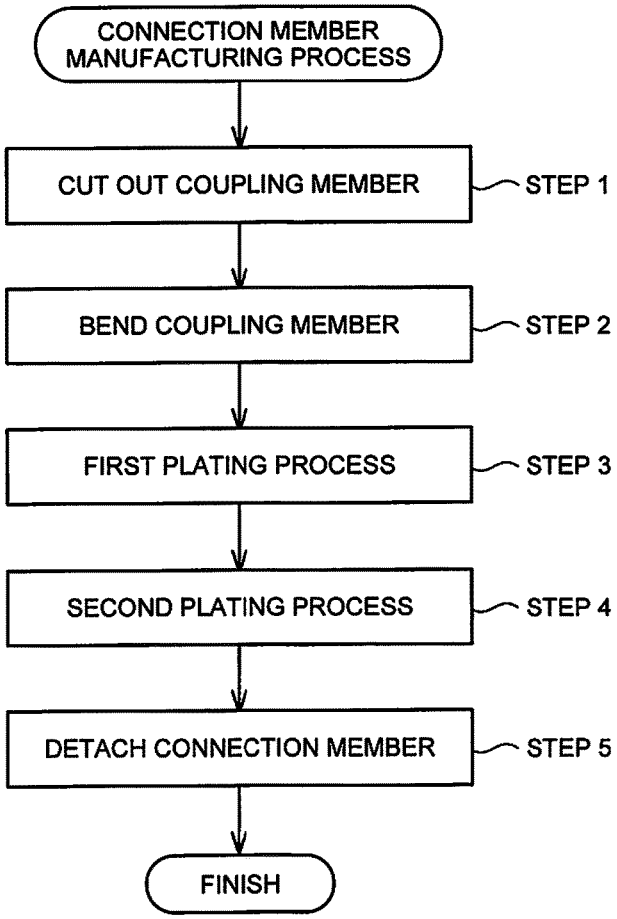
FIG. 22 is a flowchart showing a flow of a connecting member manufacturing process.

An exemplary process of manufacturing the connecting member 68 will be described with reference to FIGS. 22 to 24 in order. FIG. 22 is a flowchart showing a flow of the process of manufacturing the connecting member 68. In this manufacturing process, a plurality of connecting members 68 are simultaneously manufactured by means of multi-piece manufacturing.

Steps 1 and 2 shown in FIG. 22 will be described with reference to FIG. 23. In the step 1, a coupling member 100 is cut out from a metal plate (upper part of FIG. 23). The coupling member 100 is a tabular member, and has a support portion 101, a plurality of substrates 68*s*, and a plurality of coupling portions 103. The support portion 101 has a substantially rectangular shape. In the support portion 101, a plurality of through holes 104, which are used when transporting the coupling member 100, are arranged in a line in the longitudinal direction of the coupling member 100. The plurality of substrates 68*s* are coupled to one of the long sides of the support portion 101 via the coupling portions 103, in a state of being arranged in the longitudinal direction at given intervals. The substrates 68*s* are parts constituting the connecting members 68. The substrates 68*s* have a substantially rectangular shape, and are coupled to the support portion 101 such that their longitudinal direction is perpendicular to the longitudinal direction of the support portion 101. The coupling portions 103 are formed as constricted parts between the coupling member 100 and the upper ends of the substrates 68*s*. In the step 1, furthermore, the through holes 94 are formed at positions on the substrates 68*s* close to the lower end thereof, by means of hole punching. The lower end part of each substrate 68*s* serves as the second part 92 of the connecting member 68.

Figure 23:
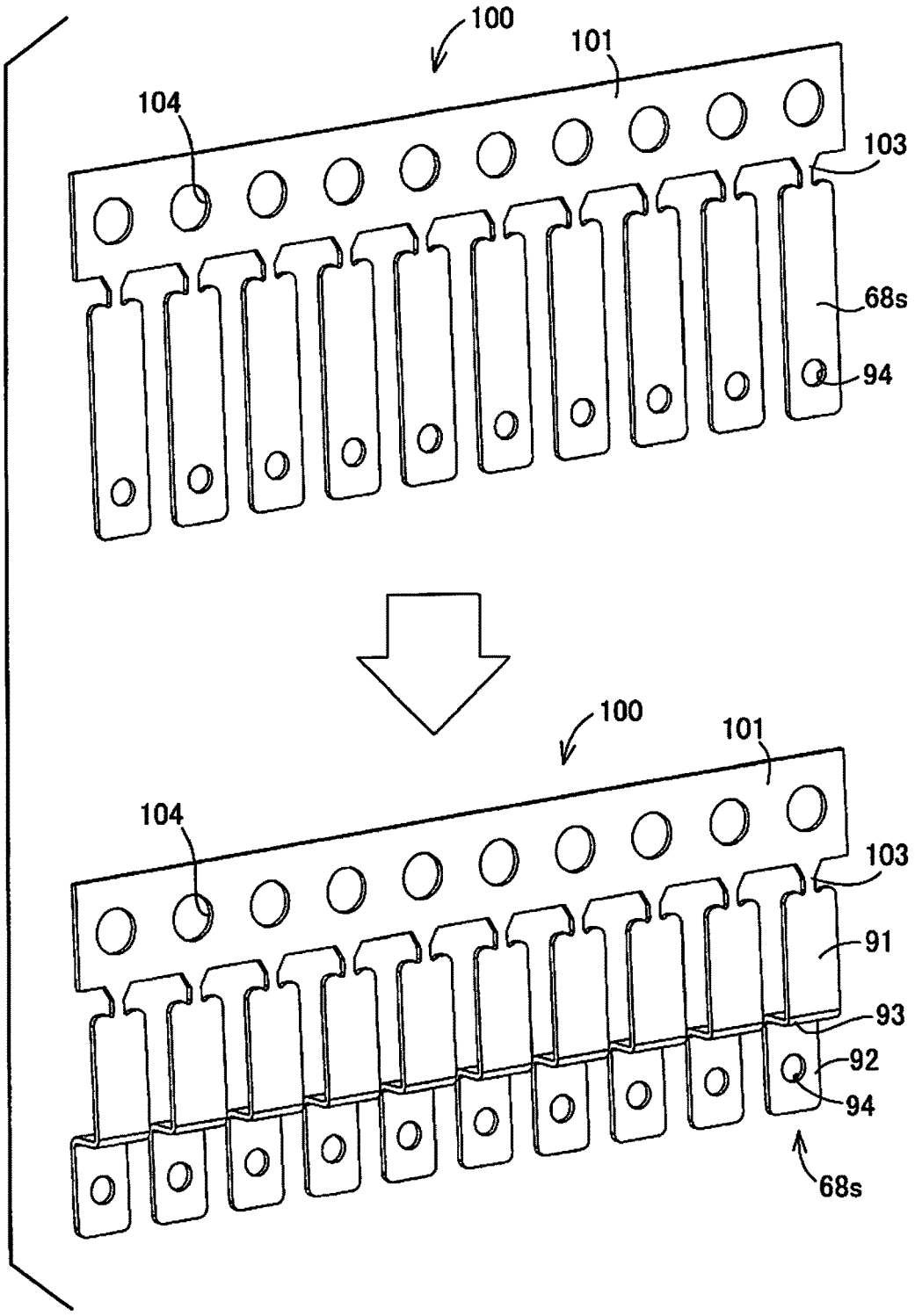
FIG. 23 is a schematic view showing a step of cutting out a coupling member and a step of bending the coupling member.

In the step 2, the substrates 68*s* are simultaneously bent in a state of being coupled to the coupling member 100 (lower part of FIG. 23). Thus, the substrates 68*s* are bent in a crank-like manner, and the first part 91, the second part 92, and the intermediate part 93 are formed.

Steps 3 and 4 shown in FIG. 22 will be described with reference to FIG. 24. In the step 3, the second parts 92 of the plurality of substrates 68*s* that are coupled to the coupling member 100 are subjected to first plating (left side in FIG. 24). In the first plating in this embodiment, the support portion 101 of the coupling member 100 is held by a holding mechanism 110, and the second part 92 at the lower end of each substrate 68*s* is immersed in a plating solution in a plating tank 111. At this time, it is desirable that the intermediate part 93 of the substrate 68*s* is located above the liquid surface in the plating tank 111. The second part 92 is covered by a first plating layer 95*a* through the first plating. The first plating layer 95*a* is for increasing the adhesion of a second plating layer 95*b*, which is formed through second plating, to the substrate 68*s*. The first plating layer 95*a* according to this embodiment is a Ni plating layer.

Figure 24:
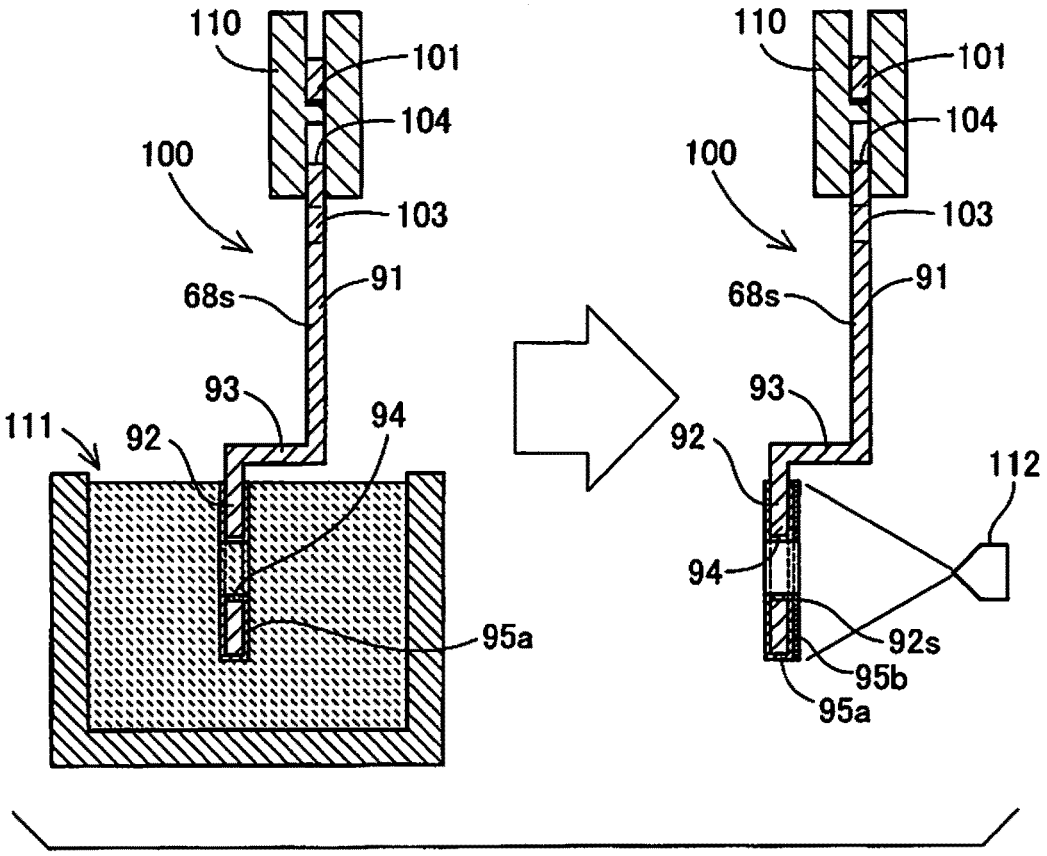
FIG. 24 is a schematic view showing a first plating step and a second plating step.

In the step 4, the second part 92 of each substrate 68*s* is subjected to the second plating (right side in FIG. 24). In the second plating, the second plating layer 95*b* is formed on the first plating layer 95*a* by spraying a plating solution onto the plating face 92*s* of the second part 92 using a spray 112. The second plating layer 95*b* is formed so as to improve adhesion of the plating to the second part 92. In this embodiment, the second plating layer 95*b* is an Au plating layer.

In this embodiment, before the plating in the steps 3 and 4, the coupling member 100 is bent in the step 2, and the intermediate part 93 that constitutes a step at the center of each substrate 68*s* is formed. In the plating in the steps 3 and 4, the intermediate part 93 functions as a protective wall that suppresses adhesion of the plating solution to the first part 91. Accordingly, a decrease in the joinability and the electrical connectivity of the terminal pins 64*a* and 64*b* to the first part 91 due to adhesion of the plating solution to the first part 91 is suppressed. In addition, in this embodiment, the through hole 94 is formed before the plating in the steps 3 and 4. Therefore, the plating layers 95*a* and 95*b* can also be formed on the inner circumferential face of the through hole 94. Accordingly, the adhesion of a solder to this inner circumferential face can be enhanced.

In the step 5 (FIG. 22), each substrate 68*s* is detached from the support portion 101 by cutting off the corresponding connecting portion 103 of the coupling member 100. Thus, the connecting member 68 is finished. As described above, with the manufacturing process according to this embodiment, the connecting member 68 can be manufactured by means of multi-piece manufacturing, which is efficient. Furthermore, in this embodiment, only the second part 92 is partially plated, and therefore, the manufacturing cost of the connecting member 68 can be reduced. In addition, as mentioned above, adhesion of the plating solution to the first part 91 during the plating is suppressed, and a decrease in the performance of the connecting member 68 can be suppressed.

A8. Circuitry for Ink Detection and Ink Detection Method

Figure 25:
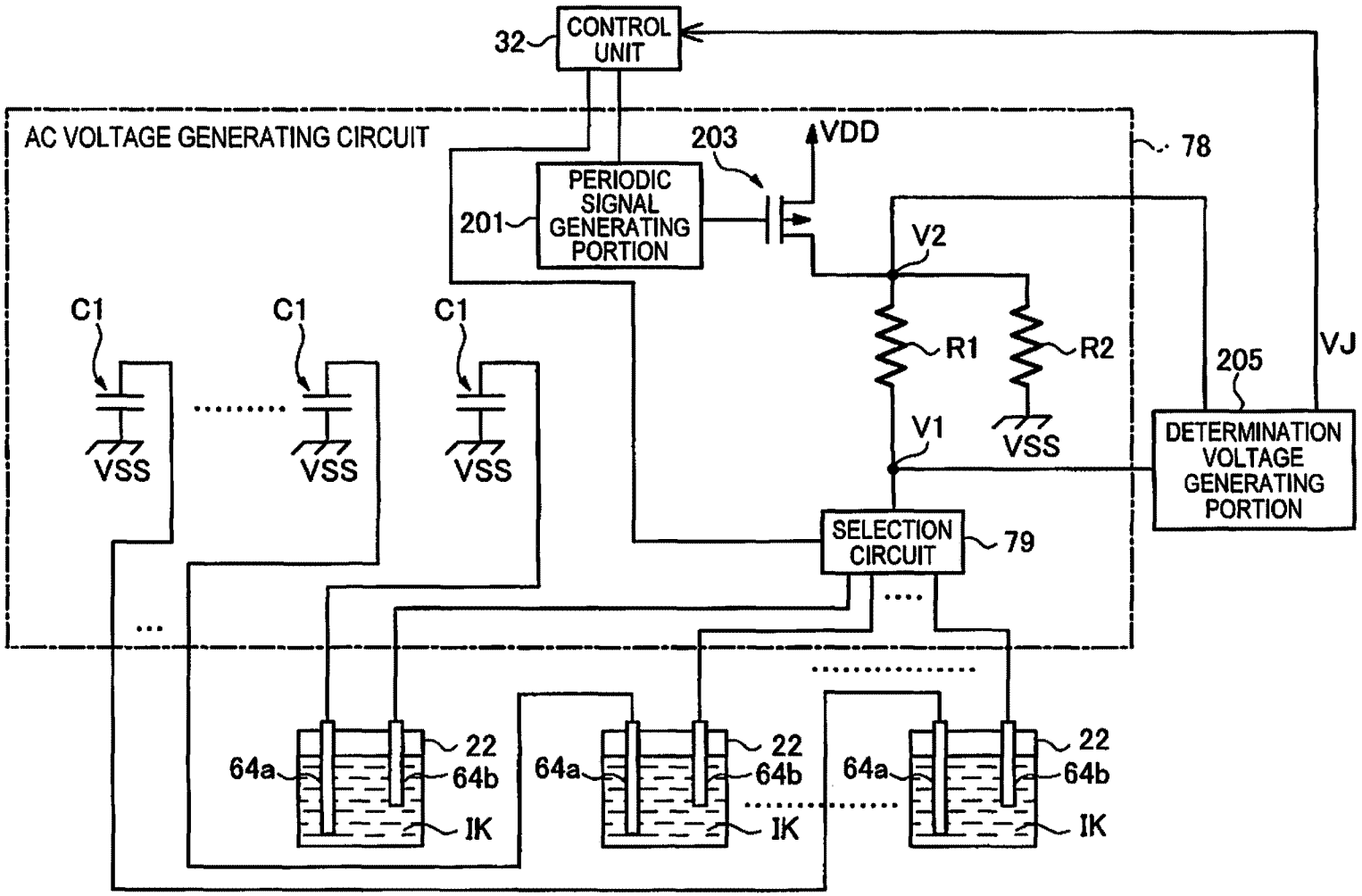
FIG. 25 is a first schematic view showing an electrical configuration of the printer.
Figure 26:
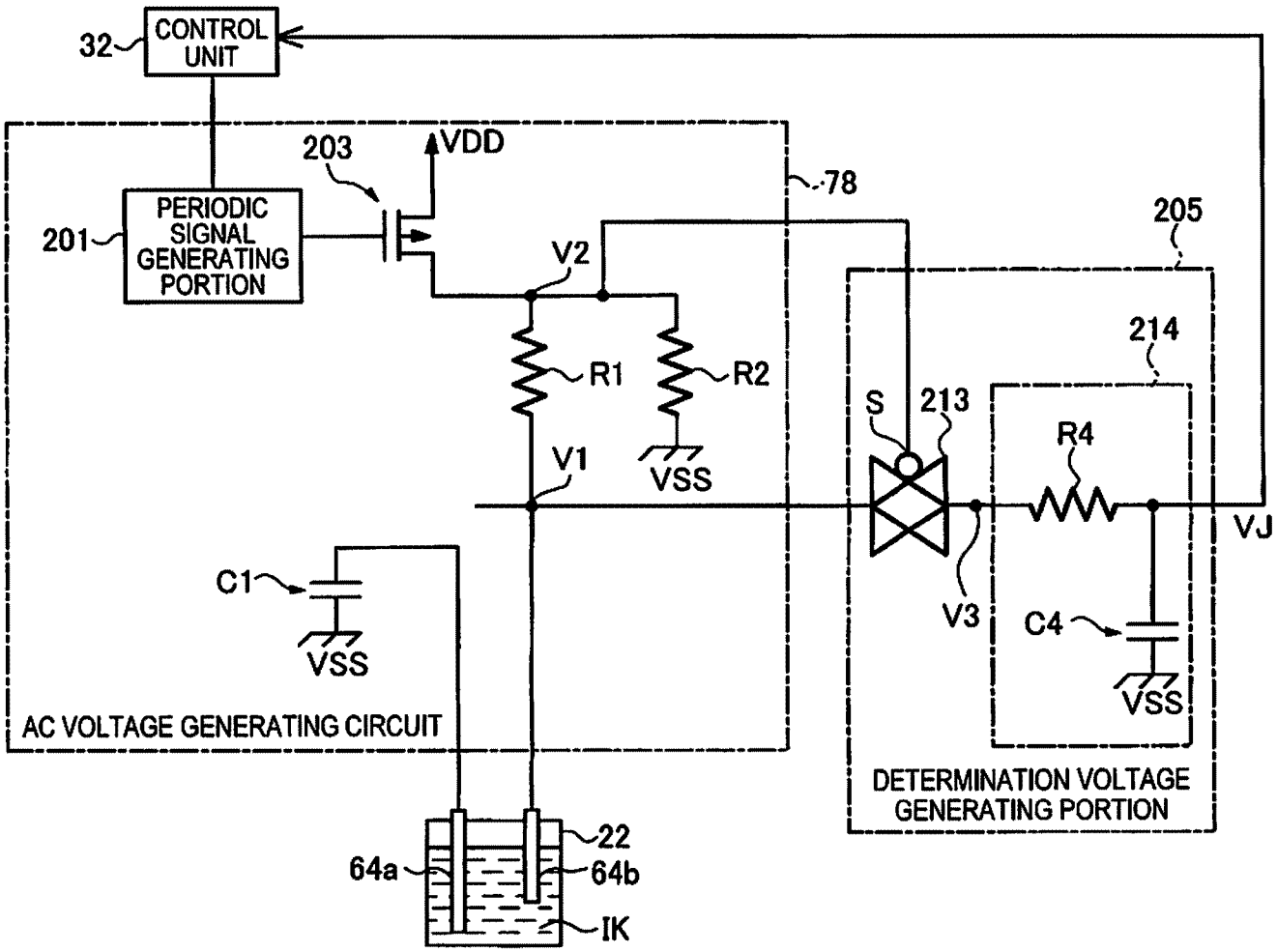
FIG. 26 is a second schematic view showing an electrical configuration of the printer.

The circuitry for detecting the ink IK and a method for detecting the ink IK in the printer 10 will be described with reference to FIGS. 25 to 27. FIGS. 25 and 26 are schematic views showing an electrical configuration of the printer 10. FIGS. 25 and 26 show the same configuration except for the following differences. FIG. 25 shows a configuration in which the alternating voltage generating circuit 78 is electrically connected to the pairs of terminal pins 64*a* and 64*b* in the plurality of ink tanks 22 via the selection circuit 79. FIG. 26 shows a configuration in which the alternating voltage generating circuit 78 is electrically connected to only the pair of terminal pins 64*a* and 64*b* in one ink tank 22 that is selected by the selection circuit 79. The selection circuit 79 is omitted for the sake of convenience. FIG. 25 omits the circuitry of a determination voltage generating portion 205, whereas FIG. 26 shows the circuitry of the determination voltage generating portion 205 in detail. Note that, in FIGS. 25 and 26, VDD denotes the potential on the high-potential side of the power supply that is connected to the circuit board 23. VSS denotes the potential on the low-potential side thereof, and is a reference potential (ground). The same signs are also used in the drawings that will be referenced below.

FIG. 25 will now be referenced. As already described, the circuit board 23 in the tank unit 20 is provided with the alternating voltage generating circuit 78, and the selection circuit 79 is included in the alternating voltage generating circuit 78. The alternating voltage generating circuit 78 is electrically connected to the control unit 32 via the wiring cable 26, and receives an electrical signal from the control unit 32. The selection circuit 79 in the alternating voltage generating circuit 78 is electrically connected, via the harness 65, to the second terminal pin 64*b* that is attached to each ink tank 22. The selection circuit 79 is constituted by a multiplexer circuit that includes an analog switch and the like, for example. The selection circuit 79 receives an electrical signal from the control unit 32 via the wiring cable 26. When the ink IK is detected, the selection circuit 79 applies an alternating voltage to one of the plurality of ink tanks 22 that is periodically selected in order, based on the electrical signal received from the control unit 32.

The printer 10 also has the determination voltage generating portion 205, which serves as a circuit portion that is used for ink detection. In this embodiment, the determination voltage generating portion 205 is provided together with the alternating voltage generating circuit 78 in the circuit board 23. The determination voltage generating portion 205 is electrically connected to the alternating voltage generating circuit 78, and generates a determination voltage VJ using an alternating voltage generated by the alternating voltage generating circuit 78. The determination voltage generating portion 205 outputs the generated determination voltage VJ to the control unit 32 via the wiring cable 26. The control unit 32 detects the ink IK in the ink tanks 22 based on the determination voltage VJ.

FIG. 26 will now be referenced. The alternating voltage generating circuit 78 includes first and second resistors R1 and R2, and a capacitor C1. One end of the first resistor R1 is connected to the second terminal pin 64*b*, and the other end is connected to the reference potential VSS via the second resistor R2. In this embodiment, a reference potential supply portion is constituted by the second resistor R2. The capacitor C1 is connected between the first terminal pin 64*a* and the reference potential VSS. Note that, in the circuit board 23, capacitors C1 are provided in one-to-one correspondence with the plurality of ink tanks 22 to be connected (FIG. 25). Thus, the accuracy of detection of the ink IK in each ink tank 22 is stabilized.

The alternating voltage generating circuit 78 (FIG. 26) also includes a periodic signal generating portion 201 and a given potential supply portion 203. The periodic signal generating portion 201 is constituted by a signal generator capable of generating a given periodic signal at various timings based on the control of the control unit 32. In this embodiment, the periodic signal generating portion 201 is constituted by a PWM circuit. In the following description, the output of the periodic signal generating portion 201 will also be called PWM output.

The given potential supply portion 203 is constituted by a p-channel FET, for example. A gate terminal of the given potential supply portion 203 is connected to the periodic signal generating portion 201, and a source terminal thereof is connected to VDD. The first resistor R1 and the second resistor R2 are connected to a drain terminal of the given potential supply portion 203. In a first period in one cycle of a given periodic signal generated by the periodic signal generating portion 201, the given potential supply portion 203 connects, via the first resistor R1, the second terminal pin 64*b* to the given potential VDD, which is a higher potential than the reference potential VSS. In a second period in one cycle, the given potential supply portion 203 disconnects the first terminal pin 64*b* and the given potential VDD.

The determination voltage generating portion 205 includes a switching circuit 213 and a smoothing circuit 214. The switching circuit 213 has a control terminal S. The control terminal S of the switching circuit 213 is connected to a node between the first and second resistors R1 and R2 in the alternating voltage generating circuit 78, and the switching circuit 213 is switched on and off in accordance with a potential V2 at this node. The determination voltage generating portion 205 transmits a voltage V1 between the first resistor R1 and the second terminal pin 64*b* to the smoothing circuit 214 at a specific timing at which the switching circuit 213 turns on. In the following description, this voltage V1 will also be called a detection voltage V1.

The smoothing circuit 214 smoothes and outputs the voltage transmitted from the switching circuit 213. The smoothing circuit 214 includes a resistor R4 and a capacitor C4. One end of the resistor R4 is connected to the switching circuit 213, and the other end of the resistor R4 is connected to one end of the capacitor C4. The other end of the capacitor C4 is connected to VSS. A potential at a node between the resistor R4 and the capacitor C4 is an output voltage of the smoothing circuit 214, and is an output voltage of the determination voltage generating portion 205. In the following description, this output voltage will also be called the determination voltage VJ. The reference potential VSS and the given potential VDD are supplied from the power supply via the wiring cable 26.

Figures 27A, 27B, 27C, 27D, 27E, 27F, 27G:
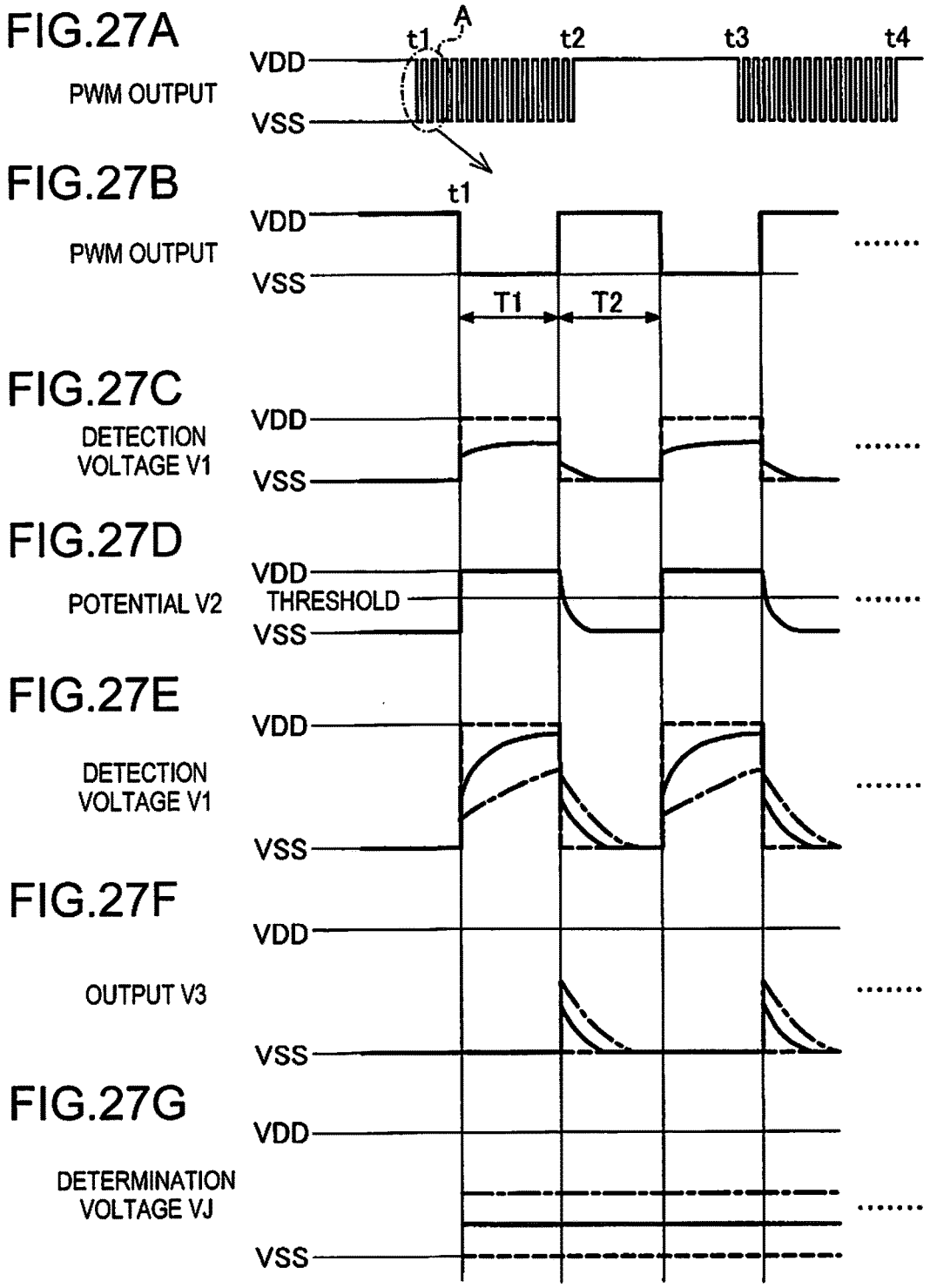
FIGS. 27A to 27G are timing charts showing changes in various voltages in ink detection processing.

FIGS. 27A to 27G are timing charts showing an exemplary change in various voltages in ink detection processing. In FIG. 27A, a temporal change in the output of the periodic signal generating portion 201 is shown as PWM output. In FIG. 27B, an area A of the PWM output surrounded by a chain double-dashed line in FIG. 27A is enlarged. In FIG. 27C, a change in the detection voltage V1 at the time when the ink IK is detected is indicated by a solid line, and a change in the detection voltage V1 at the time when the ink IK is not detected is indicated by a broken line. FIG. 27D shows a change in a potential V2 that controls operation of the switching circuit 213. In FIG. 27E, changes in the detection voltage V1 at the time when different kinds of ink IK are detected are indicated by a solid line and an alternate long and short dash line, and a change in the detection voltage V1 at the time when the ink IK is not detected is indicated by a broken line. FIG. 27F shows a change in the output of the switching circuit 213 (input to the smoothing circuit 214), and FIG. 27G shows a change in the determination voltage VJ, which is the output voltage of the smoothing circuit 214.

The periodic signal generating portion 201 is controlled by a control signal from the control unit 32 so as to start and stop periodic signal oscillation. In a period (from time t1 to time t2) in which an oscillation instruction is received from the control unit 32, the periodic signal generating portion 201 outputs a signal that periodically repeats a first period T1 in which a potential at a VSS level is output, and a second period T2 in which a potential at a VDD level is output. Upon receiving an oscillation stop signal from the control unit 32, the periodic signal generating portion 201 stops the oscillation and outputs a signal at a VDD level (from time t2 to time t3). In the following description, the period in which the oscillation instruction is received will be called a periodic signal sub-period. The periodic signal generating portion 201 periodically repeats the first period T1 and the second period T2 at the same duty ratio (50%) in the periodic signal sub-period, for example. It is desirable that the length of the periodic signal sub-period is preset to a time in which ink detection can be executed for one ink tank 22.

In the alternating voltage generating circuit 78, the given potential supply portion 203 is controlled so as to turn on and off, based on PWM output of the periodic signal generating portion 201. Specifically, the given potential supply portion 203 turns on in the first period T1 in which the gate terminal is at the VSS level, and turns off in the second period T2 in which the gate terminal is at the VDD level. As a result, the drain terminal is at the VDD level in the first period T1, and is in a high-impedance state in the second period T2. Therefore, in the first period T1, the second terminal pin 64*b* is connected to VDD via the first resistor R1, and is disconnected therefrom in the second period T2. Note that the second resistor R2 is also connected to VDD in the first period T1. Therefore, a current flows from VDD to VSS via the second resistor R2. This current increases current consumption in the alternating voltage generating circuit 78. Therefore, to prevent the increase in current consumption, it is desirable to set the value of the second resistor R2 as large as possible.

When the pair of terminal pins 64*a* and 64*b* are in contact with the ink IK, the pair of terminal pins 64*a* and 64*b* are electrically connected via the ink 1K. For this reason, in the first period T1, a current flows through a route from VDD to the given potential supply portion 203, the first resistor R1, the second terminal pin 64*b*, the ink IK, the first terminal pin 64*a*, the capacitor C1, and VSS in this order. As a result of a current flowing through this route, the capacitor C1 is charged, the potential of the capacitor C1 gradually approaches VDD, and the detection voltage V1 gradually approaches VDD in the first period T1 (FIG. 27C).

In the second period T2, the given potential supply portion 203 turns off. Therefore, the current does not flow from VDD, and the charged capacitor C1 has the highest potential in the circuit system. As a result, a current flows through a route from the capacitor C1 to the first terminal pin 64*a*, the ink IK, the second terminal pin 64*b*, the first resistor R1, the second resistor R2, and VSS in this order, and the capacitor C1 that has been charged in the first period T1 is discharged. It can be interpreted that the second resistor R2 functions as a reference potential supply portion that connects the second terminal pin 64*b* to VSS via the first resistor R1. Since the potential of the capacitor C1 gradually decreases with the discharge, the detection voltage V1 gradually approaches VSS in the second period T2 (FIG. 27C).

The direction in which a current flows in the ink IK in the first period T1 is opposite to the direction in which a current flows in the ink IK in the second period. That is to say, an alternating current flows in the ink IK in the periodic signal sub-period in which the PWM output periodically repeats the first period T1 and the second period T2.

Next, the operation of the determination voltage generating portion 205 will be described. The potential V2 that controls the switching circuit 213 changes as shown in FIG. 27D, based on the PWM output shown in FIG. 27B. Specifically, when the PWM output is at the VDD level, the given potential supply portion 203 is OFF, and therefore, the potential V2 approaches VSS via the second resistor R2. On the other hand, when the PWM output is at the VSS level, the given potential supply portion 203 is ON, and therefore, the potential V2 is VDD.

The switching circuit 213 is configured to turn off upon the potential V2 approaching VDD beyond a given threshold, and turn on upon the potential V2 falling below the given threshold and approaching VSS. Accordingly, in the second period T2 in which the potential V2 approaches VSS, the detection voltage V1 is transmitted from the switching circuit 213 to the smoothing circuit 214. On the other hand, in the first period T1 in which the potential V2 is VDD, the transmission of the detection voltage V1 is interrupted, and therefore, the output of the switching circuit 213 is in an unstable state. For this reason, in the second period T2, the detection voltage V1 appears as output V3 of the switching circuit 213, as shown in FIG. 27F.

Here, in FIG. 27E, the solid line indicates the detection voltage V1 in the case of pigment ink that has a large resistance, and the alternate long and short dash line indicates the detection voltage V1 in the case of dye ink that has a smaller resistance than that of the pigment ink. Thus, different values of the detection voltage V1 are obtained in correspondence with the types of the ink IK. As mentioned above, the output of the switching circuit 213 is transmitted to the smoothing circuit 214 and is smoothed thereby, and the determination voltage VJ is generated. As a result, as shown in FIG. 27G, a stable determination voltage VJ that has different potential levels in correspondence with the types of the ink IK is generated. Specifically, the dye ink shows the largest potential (alternate long and short dash line), and the pigment ink shows a lower potential than that of the dye ink (solid line).

The control unit 32 can detect, based on the value of the determination voltage VJ, whether or not the ink IK is present at the position of the leading end of the second terminal pin 64*b* in each ink tank 22. That is to say, it can be detected whether or not a given amount of the ink IK or more is contained in the ink containing portion 54 in each ink tank 22. It is also possible to detect the type of the ink IK by detecting a difference in the potential level of the determination voltage VJ, using an A/D converter. Thus, the control unit 32 can detect information regarding the ink IK, such as the amount of ink IK contained in the ink tank 22 and the type of the ink IK, by applying an alternating voltage to the pair of terminal pins 64*a* and 64*b* in the ink tank 22.

A9. Summary of First Embodiment

As described above, in the printer 10 according to this embodiment, the circuit board 23 and the pair of terminal pins 64*a* and 64*b* in the ink tank 22 are electrically connected by the harness 65. The electrical connection therebetween being released due to an unexpected impact or the like is suppressed. As a result of the harness 65 and the pair of terminal pins 64*a* and 64*b* being connected via the connecting member 68, the connectivity therebetween is enhanced. In the printer 10 according to this embodiment, the harness 65 is led via the through hole 81 in the board holding member 24. As a result, the manageability of the wires 66*a* and 66*b* of the harness 65 is enhanced. In the printer 10 according to this embodiment, a decrease in the accuracy of detection of the ink IK is suppressed by an arrangement configuration of the circuit portion 77 and the circuit-side connecting portions 75*a* to 75*d* in the circuit board 23. Moreover, with the printer 10 according to this embodiment, various effects described in the above embodiment can be achieved.

B. Second Embodiment

Figure 28:
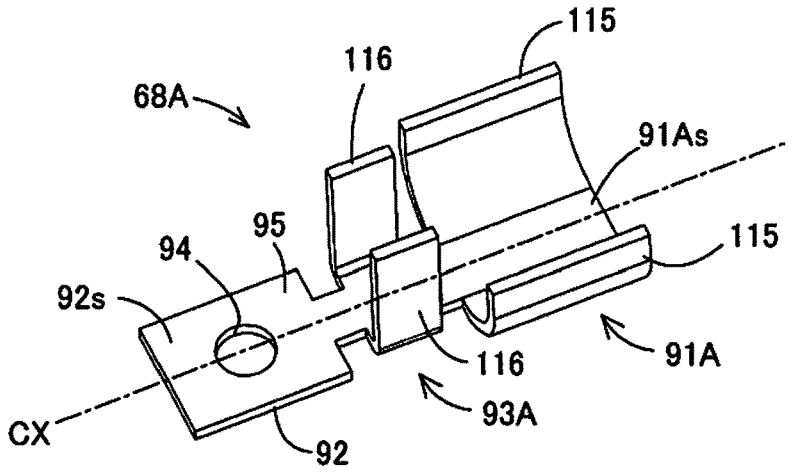
FIG. 28 is a schematic perspective view showing a connecting member according to a second embodiment.
Figure 29:
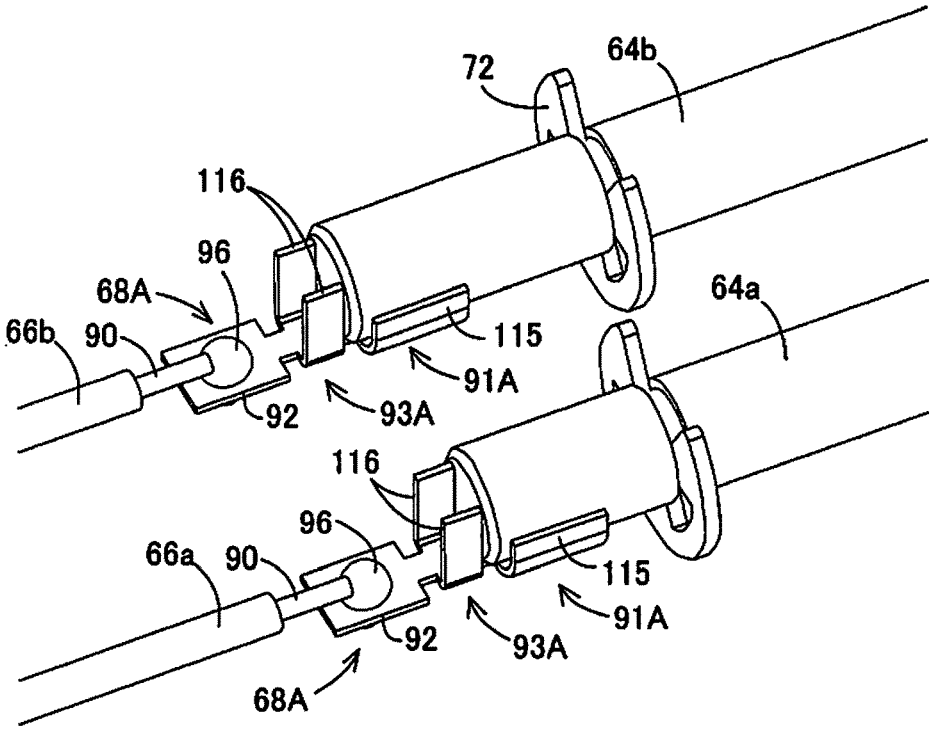
FIG. 29 is a schematic perspective view showing a state where a connecting member according to the second embodiment is attached.

A configuration of a connecting member 68A according to a second embodiment will be described with reference to FIGS. 28 and 29. FIG. 28 is a schematic perspective view of the connecting member 68A according to the second embodiment in an unused state. FIG. 29 a schematic perspective view showing a state where the connecting member 68A is attached to the pair of terminal pins 64*a* and 64*b* and the pair of wires 66*a* and 66*b* of the harness 65. The configuration of the connecting member 68A according to the second embodiment is the same as the configuration of the connecting member 68 according to the first embodiment except for the following points. The connecting member 68A can be used in place of the connecting member 68 according to the first embodiment, in the printer 10 described in the first embodiment.

In the connecting member 68A according to the second embodiment, a face of a first part 91A on the same side as the plating face 92*s* of a second part 92A is a joint face 91As to which a corresponding one of the terminal pins 64*a* and 64*b* are joined. The first part 91A is provided with holding portions 115, which curve along side faces of the corresponding one of the terminal pins 64*a* and 64*b*, on both sides with respect to a center axis CX of the connecting member 68A. In the connecting member 68A, the area of contact with the corresponding one of the terminal pins 64*a* and 64*b* and the area of welding thereto can be increased by the holding portions 115. Therefore, the contact resistance between the connecting member 68A and the corresponding one of the terminal pins 64*a* and 64*b* is reduced, and the capability to hold the corresponding one of the terminal pins 64*a* and 64*b* is enhanced.

In the connecting member 68A according to the second embodiment, an intermediate part 93A does not form a step between the first part 91A and the second part 92, and is located at the same height as the first part 91A and the second part 92 when the connecting member 68A is horizontally arranged. The intermediate part 93A is provided with two projecting walls 116. The two projecting walls 116 are formed by folding substantially rectangular tabular parts that are provided on both sides of the intermediate part 93A with the center axis CX of the connecting member 68A therebetween, at a substantially right angle in the direction toward the plating face 92*s*. When the corresponding one of the terminal pins 64*a* and 64*b* is joined to the first part 91A, end faces of the projecting walls 116 on the first part 91A side come into contact with an end face of the corresponding one of the terminal pins 64*a* and 64*b*. Thus, the projecting walls 116 each function as a positioning portion for positioning the connecting member 68A relative to the corresponding one of the terminal pins 64*a* and 64*b*.

With the connecting member 68A according to the second embodiment, the connectivity of the harnesses 65 to the terminal pins 64*a* and 64*b* can be enhanced. Moreover, with the connecting member 68A according to the second embodiment, various effects described in the first embodiment can be achieved.

C. Third Embodiment

Figure 30:
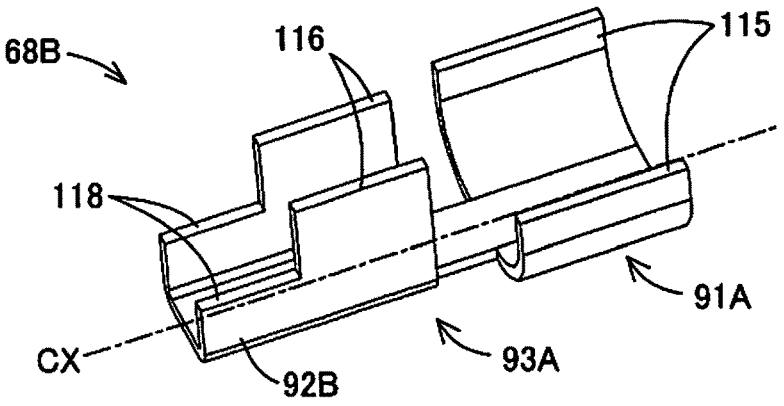
FIG. 30 is a schematic perspective view showing a connecting member according to a third embodiment.
Figure 31:
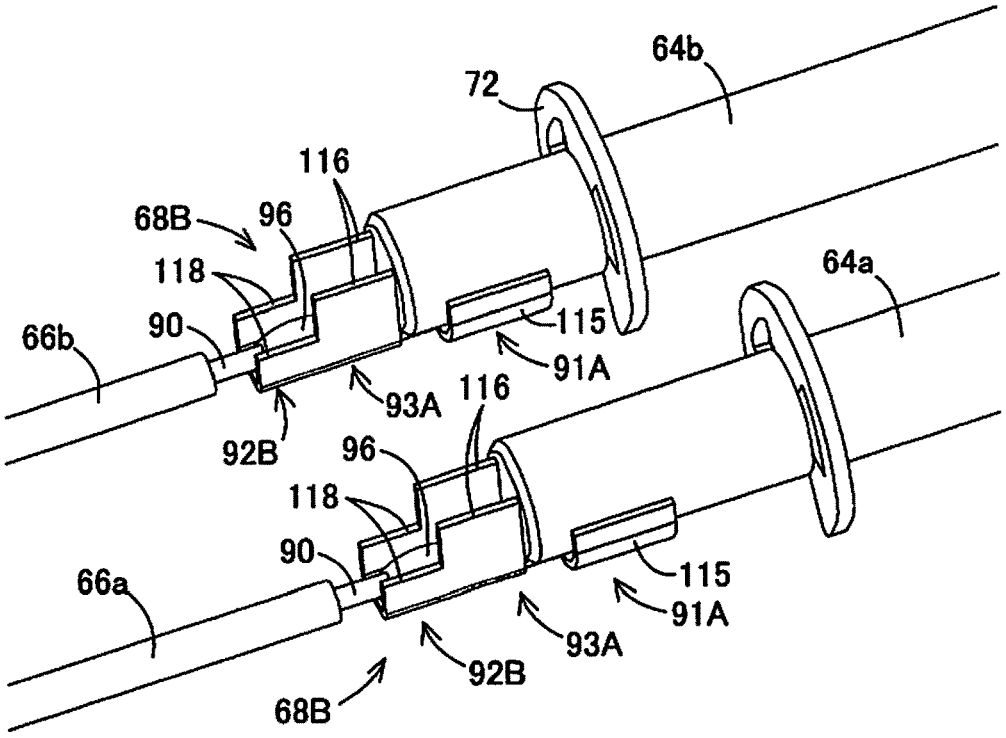
FIG. 31 is a schematic perspective view showing a state where a connecting member according to a third embodiment is attached.

A configuration of a connecting member 68B according to a third embodiment will be described with reference to FIGS. 30 and 31. FIG. 30 is a schematic perspective view of the connecting member 68B according to the third embodiment in an unused state. FIG. 31 is a schematic perspective view showing a state where the connecting member 68B is attached to the pair of terminal pins 64*a* and 64*b* and the pair of wires 66*a* and 66*b* of the harness 65. The configuration of the connecting member 68B according to the third embodiment is substantially the same as the configuration of the connecting member 68A according to the second embodiment except for the following points.

In the connecting member 68B according to the third embodiment, a second part 92B is provided with side walls 118, which are formed due to a part of the two projecting walls 116 provided in the intermediate part 93A being extended up to the second part 92B. When the wires 66*a* and 66*b* of the harness 65 is soldered to the second part 92B, the solder 96 on the plating face 92*s* enters a state of being sandwiched by the side walls 118. That is to say, the side walls 118 each function as a protective wall that protects a part to which the corresponding one of the wires 66*a* and 66*b* is connected. With the connecting member 68B according to the third embodiment, the connectivity of the harness 65 to the corresponding one of the terminal pins 64*a* and 64*b* and the protectability of the joint part of the solder 96 are enhanced. Moreover, with the connecting member 68B according to the third embodiment, various effects described in the first and second embodiments can be achieved.

D. Fourth Embodiment

Figure 32:
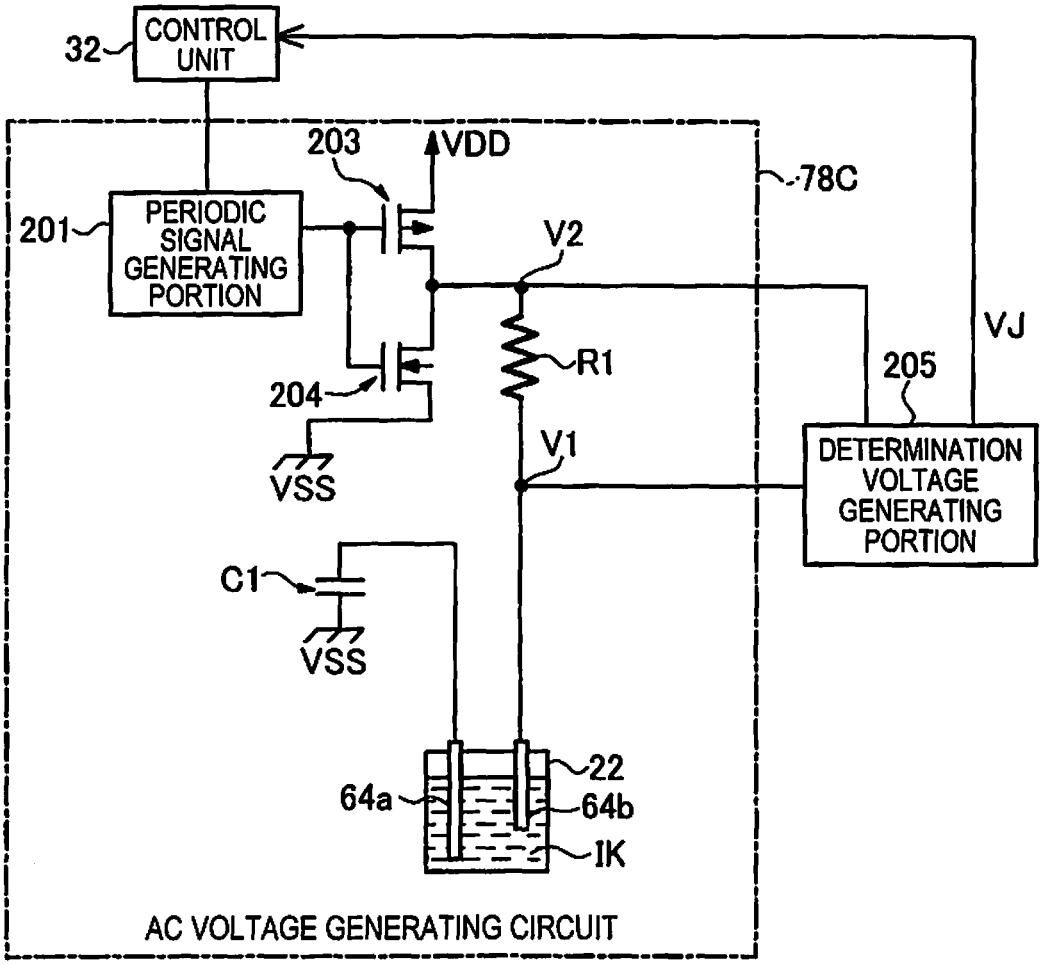
FIG. 32 is a schematic view showing circuitry of a printer according to a fourth embodiment.

FIG. 32 is a schematic view showing circuitry of the printer for detecting the ink IK according to a fourth embodiment of the invention. The printer according to the fourth embodiment has substantially the same configuration as the printer 10 according to the first embodiment except that a configuration of an alternating voltage generating circuit 78C is different as described below. In the alternating voltage generating circuit 78C according to the fourth embodiment, the second resistor R2 is omitted, and a reference potential supply portion 204 constituted by an n-channel FET is provided in addition to the given potential supply portion 203. The two potential supply portions 203 and 204 are complementarily driven as described below. When the PWM output that is output by the periodic signal generating portion 201 is in the first period T1, the given potential supply portion 203 turns on, the reference potential supply portion 204 turns off, and a current flows through the capacitor C1 via the first resistor R1 and the ink IK. On the other hand, when the PWM output is in the second period, the given potential supply portion 203 turns off, and the reference potential supply portion 204 turns on. Thus, a current flows from the capacitor C1 that has been charged in the first period T1 via the ink IK and the resistor R1. With this configuration as well, the detection voltage V1 that enables information regarding the ink IK to be detected is similarly generated, as described in the first embodiment. With the alternating voltage generating circuit 78C according to the fourth embodiment, the configuration of the alternating voltage generating circuit 78C can be simplified.

E. Modifications:

E1. Modification 1:

In the above embodiments, a voltage is applied to the ink IK in each ink tank 22 by the terminal pins 64*a* and 64*b* that are constituted by two cylindrical conductive members. In contrast, a voltage may be applied to the ink IK in each ink tank 22 by a conductive member having a configuration different from the terminal pins 64*a* and 64*b*. For example, a prism-shaped conductive member may be used, or a tabular conductive member may be used. Alternatively, a configuration in which a tabular or bar-shaped member is bent or is wound in a coil-like manner may be employed. In the above embodiments, the trailing ends of the terminal pins 64*a* and 64*b* project out of the ink tank 22. In contrast, the entire conductive member for applying a voltage to the ink IK may be housed within each ink tank 22. In this case, a configuration in which the wires 66*a* and 66*b* are drawn into the inside of the ink tank 22 may be employed. In the above embodiments, the two terminal pins 64*a* and 64*b* are inserted into the ink tank 22 in parallel from above. In contrast, the two terminal pins 64*a* and 64*b* may be inserted into the ink tank 22 from a side thereof, or may be inserted into the ink tank 22 in a direction perpendicular thereto. In the above embodiments, two terminal pins 64*a* and 64*b* are used for applying a voltage to the ink IK. In contrast, one of the two terminal pins 64*a* and 64*b* may be used for applying a voltage to the ink IK. In this case, for example, another wiring system may be formed in the ink tank 22 such that a current flows via the ink IK when a voltage is applied to the ink IK.

E2. Modification 2:

In the above embodiments, the pair of wires 66*a* and 66*b* provided in the harness 65 are connected respectively to the pair of terminal pins 64*a* and 64*b* via the connecting member 68, 68A, or 68B. In contrast, one of the pair of wires 66*a* and 66*b* may be connected to a corresponding terminal pin by the connecting member 68. In the above embodiments, the connecting members 68, 68A, and 68B are welded to the terminal pins 64*a* and 64*b* and are soldered to the wires 66*a* and 66*b*. In contrast, the connecting members 68, 68A, and 68B may be welded to both the terminal pins 64*a* and 64*b* and the wires 66*a* and 66*b*, or may be soldered to both the terminal pins 64*a* and 64*b* and the wires 66*a* and 66*b*. Alternatively, the connecting members 68, 68A, and 68B may be connected by means of any other joining methods as long as electrical connection can be ensured.

E3. Modification 3:

In the above embodiments, the pair of terminal pins 64*a* and 64*b* attached to each ink tank 22 are electrically connected to the circuit board 23 via the harness 65 that is an exemplary wiring member. In contrast, the pair of terminal pins 64*a* and 64*b* may be separately connected to the circuit board 23 by two wires in place of the harness 65. In this case, a configuration may be employed in which the circuit-side connecting portions 75 of the circuit board 23 are omitted, and the wires are directly connected to the wiring part of the circuit board 23 by means of soldering or the like.

E4. Modification 4:

In the above embodiments, an alternating voltage is applied to the ink IK contained in each ink tank 22 to detect the ink. In contrast, a direct voltage, rather than an alternating voltage, may be applied to the ink IK contained in the ink tank 22. In this case, the control unit 32 may detect information regarding the ink, such as the presence of the ink IK and the type of the ink IK, based on a resistance value detected between the two terminal pins 64*a* and 64*b* when a direct voltage is applied to the ink IK, for example.

E5. Modification 5:

In the above embodiments, the terminal pins 64*a* and 64*b* are made of stainless steel. In contrast, the terminal pins 64*a* and 64*b* may be made of a metallic material other than stainless steel. For example, the terminal pins 64*a* and 64*b* may be made of iron, copper, carbon, or an alloy that includes such materials as main components. In the above embodiments, the connecting members 68, 68A, and 68B are made of stainless steel, similar to the terminal pins 64*a* and 64*b*. In contrast, the connecting members 68, 68A, and 68B may be made of the aforementioned metallic materials other than stainless steel. The plating layer 95 formed in the connecting members 68, 68A, and 68B is not limited to an Ni plating layer and an Au plating layer, and the type and method of plating may be selected as appropriate in accordance with the type of the constituent material of the connecting members 68, 68A, and 68B.

E6. Modification 6:

In the above embodiments, the pair of wires 66*a* and 66*b* are passed together through a corresponding one of the through holes 81 provided in the board holding member 24. In contrast, the wires 66*a* and 66*b* may be individually passed through different through holes provided in the board holding member 24. In the above embodiments, the through holes 81*a* to 81*d* in the board holding member 24 are provided at positions shifted from the positions of the corresponding circuit-side connecting portions 75*a* to 75*d*. In contrast, the through holes 81*a* to 81*d* may be formed below the corresponding circuit-side connecting portions 75*a* to 75*d*, or may be formed so as to be located in front of the respective circuit-side connecting portions 75*a* to 75*d* in the opening direction. In the above embodiments, the through holes 81*a* to 81*d* in the board holding member 24 are formed such that a part of the opening region of each of the through holes 81*a* to 81*d* does not overlap the circuit board 23 as viewed in the direction opposite to the arrow Z. In contrast, the through holes 81*a* to 81*d* in the board holding member 24 may be formed at positions at which the entire opening regions are covered by the circuit board 23 as viewed in the direction opposite to the arrow Z.

E7. Modification 7:

In the above embodiments, the printer 10 includes four ink tanks 22. In contrast, the number of ink tanks 22 included in the printer 10 is not limited to four. The printer 10 may include only one ink tank 22. Alternatively, the printer 10 may include two or three ink tanks 22, or may include five or more ink tanks 22. The printer 10 may include k (k is an integer of 2 or more) ink tanks 22, k pairs of terminal pins 64*a* and 64*b*, and k harnesses 53, and k harnesses 53, and may be provided with k circuit-side connecting portions 75 in the circuit board 23.

E8. Modification 8:

The constituent portions described in the above first embodiment may be omitted or modified as appropriate. For example, one of or both the fixing member 69 and the base member 71 may be omitted. The partition wall 84, the tabular parts 85*a* and 85*b*, the suspended walls 88, or the like in the board holding member 24 may be omitted. The hooks 72 of the terminal pins 64*a* and 64*b* may be omitted. In the above embodiments, the circuit board 23 extends in the arrow X direction so as to be installed across the ink tanks 22. In contrast, the circuit board 23 may not extend in the arrow X direction, and divided circuit boards 23 may be arranged in the arrow X direction on the board holding member 24. In addition, the circuit board 23 and the board holding member 24 may not be arranged above the ink tanks 22, and may be arranged on the back face side, for example.

E9. Modification 9:

The order of the steps in the process of assembling the tank unit 20 described in the first embodiment may be changed, or some steps may be omitted, as appropriate. For example, the step 2 and the step 3 may be replaced with each other, and the terminal assembly 63 may be attached, via the through corresponding hole 81, to each ink tank 22 that is coupled to the board holding member 24. The step 3 and the step 4 may be replaced with each other, and the board holding member 24 in a state of holding the circuit board 23 may be screwed to the ink tanks 22. Moreover, in the step 1, the fixing member 69 may be attached to the harness 65 after the connecting member 68 has been attached to the harness 65.

E10. Modification 10:

In the above embodiments, the printer 10 may have circuitry other than the circuitry for ink detection described in the above first embodiment or the fourth embodiment, and the ink may be detected using a method other than the method described with reference to FIG. 27. For example, as mentioned above, the printer 10 may have circuitry that generates a direct voltage for ink detection, and a direct voltage may be applied to the ink.

E11. Modification 11:

In the above embodiments, the circuit portion 77 in the circuit board 23 is provided with the alternating voltage generating circuit 78 including the selection circuit 79, and the determination voltage generating portion 205. In contrast, the circuit portion 77 in the circuit board 23 may be provided with only the selection circuit 79, and the other circuit may be provided in a part separate from the circuit board 23. For example, the determination voltage generating portion 205 may be provided in the printing unit 30.

E12. Modification 12:

In the above embodiments, the configuration of the printer 10 that is an inkjet printer has been described as a mode of a liquid discharging apparatus to which the invention of the present application is applied. In contrast, the invention of the present application may be applied to a liquid consuming apparatus other than an inkjet printer. For example, the invention may be applied to a liquid ejection apparatus that ejects high-pressure water, for example.

The invention is not limited to the above embodiments, examples, and modifications, and can be achieved in various configurations without departing from the gist of the invention. For example, the technical features in the embodiments, examples, and modifications corresponding to the technical features in the modes described in the summary of the invention may be replaced or combined as appropriate, in order to solve a part of or the entire problem described above, or to achieve some or all of the effects described above. The technical features that are not described as essential in the specification may be deleted as appropriate.

This application claims the benefit of foreign priority to Japanese Patent Application No. JP2016-2499, filed Jan. 8, 2016, which are incorporated by reference in its entirety.

What is claimed is:

1. A liquid consuming apparatus comprising:

a liquid container in which liquid is contained;

a conductive member having a first end and a second end, the first end being arranged within the liquid container and the second end being arranged outside the liquid container;

a circuit board that is arranged outside the liquid container and applies a voltage to the conductive member;

a wire that electrically connects the conductive member and the circuit board to each other; and a board holding member that is arranged between the liquid container and the circuit board and holds the circuit board, wherein the board holding member is provided with a through hole through which the wire is passed, the wire being connected to the circuit board through the through hole, the conductive member and the wire are connected to each other via a connecting member, the connecting member having a welding part to which the conductive member is welded, and a soldering part to which the wire is soldered, the conductive member includes a first conductive member and a second conductive member, the wire includes a first wire connected to the first conductive member, and a second wire connected to the second conductive member, the first wire and the second wire being connected to the circuit board via the through hole, a connector is interposed for connection of the first wire and the second wire to the circuit board, a wiring member being formed by the first wire, the second wire and the connector, and the circuit board includes a connecting portion to which the connector is connected.

2. The liquid consuming apparatus according to claim 1, wherein the through hole has an opening region that does not overlap the circuit board, when viewed in an opening direction of the through hole, and the wire extends out toward the circuit board via the opening region.

3. The liquid consuming apparatus according to claim 1, further comprising:

a plurality of the liquid containers, wherein the liquid containers each include a pair of the first conductive member and the second conductive member that are connected to the circuit board via the wiring member, the board holding member is installed spanning the liquid containers so as to face the liquid containers, and the board holding member is provided with a plurality of the through holes at positions corresponding to the plurality of liquid containers.

4. The liquid consuming apparatus according to claim 1, wherein the first conductive member and the second conductive member are each a columnar member, the first conductive member and the second conductive member are inserted in parallel into the liquid container such that leading ends of the first conductive member and the second conductive member are arranged within the liquid container, the first wire is connected to a trailing end of the first conductive member projecting from the liquid container, the second wire is connected to a trailing end of the second conductive member projecting from the liquid container, and the through hole is located on extensions of center axes of the first conductive member and the second conductive member.

5. The liquid consuming apparatus according to claim 4, wherein the connecting portion is located at a position shifted from extensions of center axes of the first conductive member and the second conductive member.

6. The liquid consuming apparatus according to claim 1, further comprising:

a control unit that is connected to the circuit board via a wiring cable, and detects information regarding the liquid by using the voltage applied to the conductive member by the circuit board.

7. The liquid consuming apparatus according to claim 6, wherein the control unit detects, as the information regarding the liquid, information regarding an amount of the liquid contained in the liquid container.

8. A liquid consuming apparatus assembly method comprising:

a wire connecting step of attaching a wire to a conductive member;

a conductive member attaching step of arranging a first end of the conductive member within a region where liquid is contained in a liquid container, in which the liquid is to be contained, and arranging a second end of the conductive member outside the liquid container;

a board arranging step of causing a board holding member to hold a circuit board that applies a voltage to the conductive member, and arranging the board holding member such that the board holding member is located between the circuit board and the liquid container; and a wiring step of electrically connecting the circuit board and the conductive member to each other by passing the wire through a through hole provided in the board holding member, leading the wire from the liquid container to the circuit board, and connecting the wire to the circuit board, wherein the conductive member includes a first conductive member and a second conductive member, the wire includes a first wire and a second wire, the wire connecting step is a step of connecting the first wire to the first conductive member, and connecting the second wire to the second conductive member, the wiring step is a step of connecting the first wire and the second wire to the circuit board via the through hole, the wire connecting step is a step of connecting the conductive member and the wire to each other via a connecting member, and includes a step of welding the conductive member to the connecting member and a step of soldering the wire to the connecting member, a connector is interposed for connection of the first wire and the second wire to the circuit board, a wiring member being formed by the first wire, the second wire and the connector, and the circuit board includes a connecting portion to which the connector is connected.

9. The assembly method according to claim 8, further comprising:

a cable wiring step of electrically connecting the circuit board and a control unit that detects information regarding the liquid using the voltage applied to the liquid by the circuit board, to each other via a wiring cable.

* * * * *